US012491396B1

(12) United States Patent
Neal, Jr. et al.

(10) Patent No.: US 12,491,396 B1
(45) Date of Patent: Dec. 9, 2025

(54) ADJUSTABLE RESISTANCE EXTREMITY STRENGTHENING SYSTEM AND METHODS OF USING THE SAME

(71) Applicant: Ollite Athletics, LLC, Dallas, TX (US)

(72) Inventors: Scott Alan Neal, Jr., Dallas, TX (US); Brandt Kenneth Frankie, San Jose, CA (US)

(73) Assignee: Ollite Athletics, LLC, Dallas, TX (US)

( * ) Notice: Subject to any disclaimer, the term of this patent is extended or adjusted under 35 U.S.C. 154(b) by 340 days.

(21) Appl. No.: 18/305,724

(22) Filed: Apr. 24, 2023

Related U.S. Application Data

(60) Provisional application No. 63/334,880, filed on Apr. 26, 2022.

(51) Int. Cl.
*A63B 21/00* (2006.01)
*A63B 21/05* (2006.01)
*A63B 26/00* (2006.01)

(52) U.S. Cl.
CPC ..... *A63B 21/00072* (2013.01); *A63B 21/05* (2013.01); *A63B 21/4015* (2015.10); *A63B 21/4035* (2015.10); *A63B 21/4049* (2015.10); *A63B 21/00065* (2013.01); *A63B 26/003* (2013.01); *A63B 2214/00* (2020.08); *A63B 2225/093* (2013.01)

(58) Field of Classification Search
CPC ..... A63B 21/00072; A63B 21/05; A63B 21/4015; A63B 21/4035; A63B 21/4049; A63B 21/00065; A63B 2214/00; A63B 2225/093; A63B 26/003–2026/006; A63B 22/14–2022/185
See application file for complete search history.

(56) References Cited

U.S. PATENT DOCUMENTS 4,739,986 A * 4/1988 Kucharik ..... A63B 23/08 482/79
5,613,690 A * 3/1997 McShane ..... G06F 3/0334 428/902

(Continued)

FOREIGN PATENT DOCUMENTS

KR 20140005720 A * 1/2014 ..... A63B 22/16

OTHER PUBLICATIONS

Translation of KR-20140005720-A (Year: 2014).*

*Primary Examiner* — Megan Anderson
*Assistant Examiner* — Catrina A Letterman
(74) *Attorney, Agent, or Firm* — Foley IP Law, PLLC

(57) ABSTRACT

An apparatus for providing resistance-based extremity strengthening. The apparatus includes a base configured to be placed on or secured to a floor or other surface; a platform upon which a user is configured to place an extremity of their body to engage the apparatus; and a joint coupling the base and the platform, the joint having a fulcrum point and configured to allow for the platform to rotate about the fulcrum point. The apparatus further includes a plurality of elastic resistance bands each configured to be selectively engaged with any of a plurality of platform connection points of the platform and any of a plurality of base connection points of the base. The user is configured use their extremity to rotate the platform about the fulcrum point of the joint, and the rotation is resisted by the plurality of elastic resistance band.

20 Claims, 23 Drawing Sheets

(56) References Cited

U.S. PATENT DOCUMENTS

| | | | | |
|---|---|---|---|---|
| 5,667,462 | A * | 9/1997 | Gordon | A63B 22/18 482/80 |
| 5,755,651 | A * | 5/1998 | Homyonfer | A63B 22/16 482/130 |
| 6,428,451 | B1 * | 8/2002 | Hall | A63G 23/00 482/79 |
| 7,322,914 | B1 * | 1/2008 | Vittone | A63B 23/025 482/146 |
| 9,533,191 | B2 * | 1/2017 | Carbone | A63B 26/003 |
| 9,776,030 | B1 * | 10/2017 | Louis | A63B 5/11 |
| 2002/0077231 | A1 * | 6/2002 | Dalebout | A63B 22/18 482/146 |
| 2011/0281701 | A1 * | 11/2011 | Zhang | A63B 22/14 482/146 |
| 2019/0175983 | A1 * | 6/2019 | Carr | A63B 22/18 |
| 2022/0266089 | A1 * | 8/2022 | Burdenko | A63B 26/003 |
| 2023/0072184 | A1 | 3/2023 | Villarreal | |

* cited by examiner

ADJUSTABLE RESISTANCE EXTREMITY STRENGTHENING SYSTEM AND METHODS OF USING THE SAME

CROSS-REFERENCE TO RELATED APPLICATION

This application claims priority to U.S. Provisional Patent Application No. 63/334,880, filed on Apr. 26, 2022 and entitled "Adjustable Resistance Extremity Strengthening System and Methods of Using the Same". The entire disclosure of the above application is incorporated herein by reference.

FIELD OF THE INVENTION

This invention relates to an adjustable resistance system for upper and lower extremities of the human body for physical fitness to strengthen the extremities. More particularly, this invention relates to resistance-based training systems and methods of using the same for physical therapy, physical rehabilitation, and physical injury prevention.

BACKGROUND

As technology advances in exercise science and kinesiology studies, we find areas to improve and modify exercise products to account for the continual growth in knowledge. Currently, there is not a single product that can account for all necessary exercises during recovery of certain injuries of the extremities, such as, for example, certain injuries to the foot/ankle and hand/wrist.

Throughout various stages of physical therapy, physical conditioning, and active recovery, the use of resistance bands is necessary to advance healing, revive movement, and restore functional fitness. The range of motions vary, along with the force needed for safe and effective movements. Many exercises require securing a resistance band to a post to support the desired range of motion needed. Other exercises require a limited range of motion to reduce the chance of injury.

While there are many foot/ankle and hand/wrist resistance systems and methods known, the known systems are limited in many aspects. Therefore, a need exists for an adjustable resistance system and method that can provide rotation and flexing resistance in a singular device. There is also a need for a light and compact system that can be secured anywhere using the operator's weight to anchor the system. Finally, there is a need for a system and method that can be rapidly reconfigured and adjusted to adapt to the required functional movements or limitations under their specific circumstance.

SUMMARY

Various embodiments of this disclosure relate to an apparatus for providing resistance-based extremity strengthening. The apparatus includes comprising a base configured to be placed on or secured to a floor or other surface; a platform upon which a user is configured to place an extremity of their body to engage the apparatus; and a joint coupling the base and the platform, the joint coupled to a top surface of the base and a bottom of the platform and aligned with a center axis of the platform, the joint having a fulcrum point and configured to allow for the platform to rotate about the fulcrum point in all three planes. The apparatus further includes a plurality of elastic resistance bands each having a first end configured to be selectively engaged with any of a plurality of platform connection points of the platform, and a second end configured to be selectively engaged with any of a plurality of base connection points of the base. According to various embodiment, the plurality of platform connection points are disposed substantially evenly about an outer section of the platform, each of the plurality of platform connection points disposed at a first distance from the center axis of the platform. According to various embodiments, each of the plurality of base connection points are disposed on the base on substantially a same vertical plane as a corresponding one of the plurality of platform connection points and at a second distance from the center axis of the platform, where the second distance is less than or equal to the first distance.

According to various embodiments, the joint of the apparatus is configured to have an adjustable height such that a distance between the platform and base is configured to be changed based on the height of the joint.

According to various embodiments, each of the plurality of platform connection points comprises a slot spanning a thickness of the platform and formed in an outer circumferential edge of the platform such that that elastic resistance band first end is configured to radially enter the slot from the outer edge of the platform relative to the center axis of the platform. The first end of each of the plurality of elastic resistance bands includes a stopper, wherein the stopper has a cross-section that is wider than a cross-section of an elastic portion of the elastic resistance band. The first end of each of the plurality of resistance bands is configured to be coupled to any of the platform connection points by radially inserting the elastic portion into the slot and seating the stopper in the slot.

According to various embodiments, each of the plurality of base connection point comprises a through-hole positioned on the top surface of the base. The second end of each of the plurality of resistance bands includes a hook and is configured to be coupled with any of the plurality of the base connection points by inserting the hook into the through-hole.

According to various embodiments, the joint is a ball-and-socket joint allowing for five degrees of freedom and comprising a socket coupled to the bottom surface of the platform; a sleeve coupled to the top of the base; a ball element including a ball and a stem, wherein the stem is configured to be inserted in the sleeve and the ball is configured to engage the socket; and a coupling configured to operatively couple the ball and the socket. Where the coupling is configured to limit the amount by which the platform is able to pitch and roll.

According to various embodiments, the joint stem includes a plurality of through-holes disposed along a length of the stem and the joint sleeve includes a pin hole with which one of the plurality of through-holes is configured to be axially aligned. The joint further includes a pin configured to pass through the pin hole of the sleeve and engage an aligned through-hole of the stem, wherein the height of the joint is adjustable based on which of the through-holes is engaged by the pin.

According to various embodiments, the extremity engaging the apparatus is the user's foot and the foot rotating the platform about the fulcrum point of the joint strengthens tendons, muscles, and/or joints of the user's leg and/or foot. The apparatus further includes a strap configured to couple the user's foot to the platform. According to various embodiments, the apparatus further includes a hand grip disposed on a top surface of the platform and the extremity is the user's hand and the user is configured to grab the hand grip to engage the apparatus. The hand rotating the platform about the fulcrum point of the joint strengthens tendons, muscles, and/or joints of the user's hand, arm and/or shoulder.

Various embodiments of this disclosure relate to a method for providing resistance-based extremity strengthening. Various methods include providing a resistance extremity strengthening apparatus disclosed herein; coupling a first end of each of the plurality of elastic resistance bands with any one of a plurality of platform connection points of the platform, and coupling a second end of each of the plurality of elastic resistance bands with any one of a plurality of the base connection points of the base. Various embodiments include further include rotating, using the extremity of the user's body, the platform about the fulcrum point of the joint, wherein the rotation is resisted by the plurality of elastic resistance bands.

DETAILED DESCRIPTION OF THE INVENTION

Figure 1:
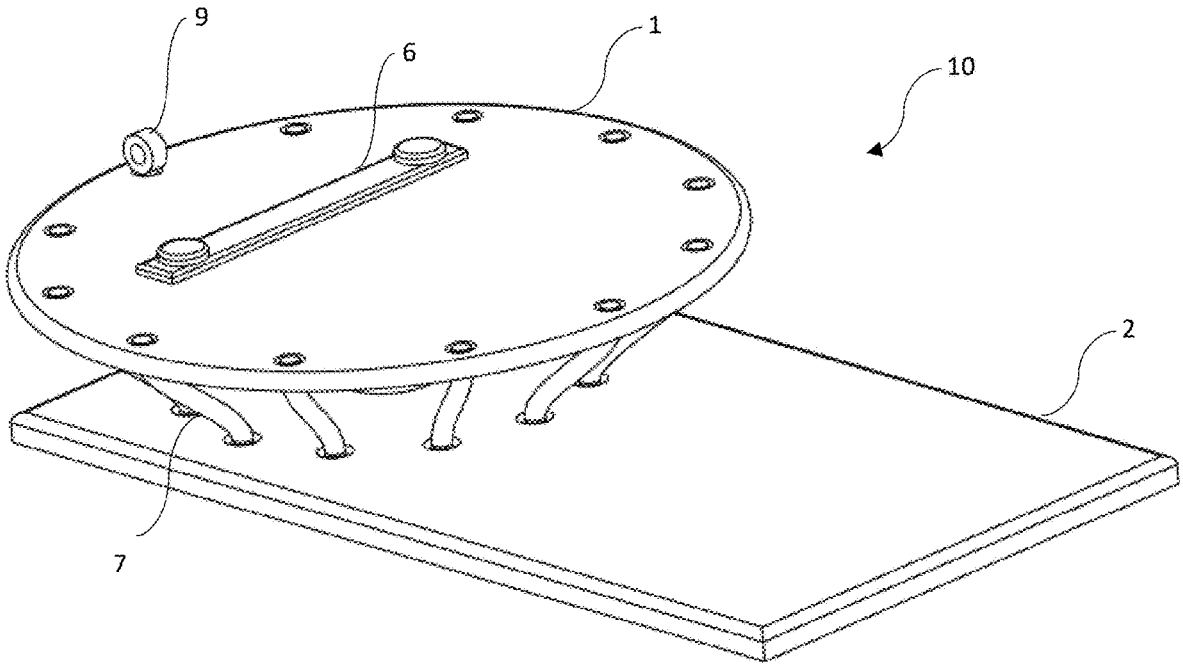
FIG. 1 illustrates a perspective view of an extremity resistance system, according to an embodiment of this disclosure.

The following examples are described to illustrate preferred embodiments for carrying out the invention in practice, as well as certain preferred alternative embodiments to the extent they seem particularly illuminating at the time of this writing. In the course of understanding these various descriptions of preferred and alternative embodiments, those of skill in the art will be able to gain a greater understanding of not only the invention but also some of the various ways to make and use the invention and embodiments thereof.

For purposes of these descriptions, a few wording simplifications should be understood as universal, except to the extent otherwise clarified in a particular context either in the specification or in any claims. For purposes of understanding descriptions that may be basic to the invention, the use of the term "or" should be presumed to mean "and/or" unless explicitly indicated to refer to alternatives only, or unless the alternatives are inherently mutually exclusive. When referencing values, the term "about" may be used to indicate an approximate value, generally one that includes a standard deviation of error for any particular embodiments that are disclosed or that are commonly used for determining or achieving such value. Reference to one element, often introduced with an article like "a" or "an", may mean one or more, unless clearly indicated otherwise. Such "one or more" meanings are most especially intended when references are made in conjunction with open-ended words such as "having," "comprising" or "including." Likewise, "another" may mean at least a second or more. Other words or phrases may have defined meanings either here or in the accompanying background or summary descriptions, and those defined meanings should be presumed to apply unless the context suggests otherwise.

These descriptions occasionally point out and provide perspective as to various possible alternatives to reinforce that the invention is not constrained to any particular embodiments, although described alternatives are still just select examples and are not meant to represent an exhaustive identification of possible alternatives that may be known at the time of this writing. The descriptions may occasionally even rank the level of preference for certain alternatives as "most" or "more" preferred, or the like, although such ranked perspectives should be given little importance unless the invention as ultimately claimed irrefutably requires as much. Indeed, in the context of the overall invention, neither the preferred embodiments nor any of the referenced alternatives should be viewed as limiting unless our ultimate patent claims irrefutably require corresponding limits without any possibility for further equivalents, recognizing that many of the particular elements of those ultimate patent claims may not be required for infringement under the U.S. Doctrine of Equivalents or other comparable legal principles. Having said that, even though the invention should be presumed to cover all possible equivalents to the claimed subject matter, it should nonetheless also be recognized that one or more particular claims may not cover all described alternatives, as would be indicated either by express disclaimer during prosecution or by limits required in order to preserve validity of the particular claims in light of the prior art.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, apparatuses, and the like described herein may be positioned in any desired orientation. Thus, the use of terms such as "above," "below," "upper," "lower" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. In addition, as used herein, the term "coupled" may include direct or indirect coupling by any means, including moving and/or non-moving mechanical connections.

FIG. 1 illustrates an extremity resistance system 10, according to an embodiment of this disclosure. System 10 comprises a top platform 1 coupled to a base platform 2 by a joint 12 (illustrated in FIG. 3 and discussed in greater detail below) and a plurality of resistance bands 7. System 10 further comprises a strap 6 mounted on platform 1 by mounting mechanisms 8 that a user can use to secure an extremity, such as the hand or foot, to platform 1 when in use. System 10 further comprises a ring 9 mounted to platform 1 at which resistance bands or weights can be attached to platform 1 to add additional resistance. As will be discussed in greater detail below, a user uses system 10 by placing an extremity, such as a hand or foot, on platform 1 and rotating and tilting platform 1 about a fulcrum point of joint 12 with the extremity. Bands 7 provide resistance against the movements performed by the user on the platform. Further, the user places another of their extremities, such as their other hand or foot, on base 2 as an anchor to ensure system 10 remains steady while in operation.

Figure 2:
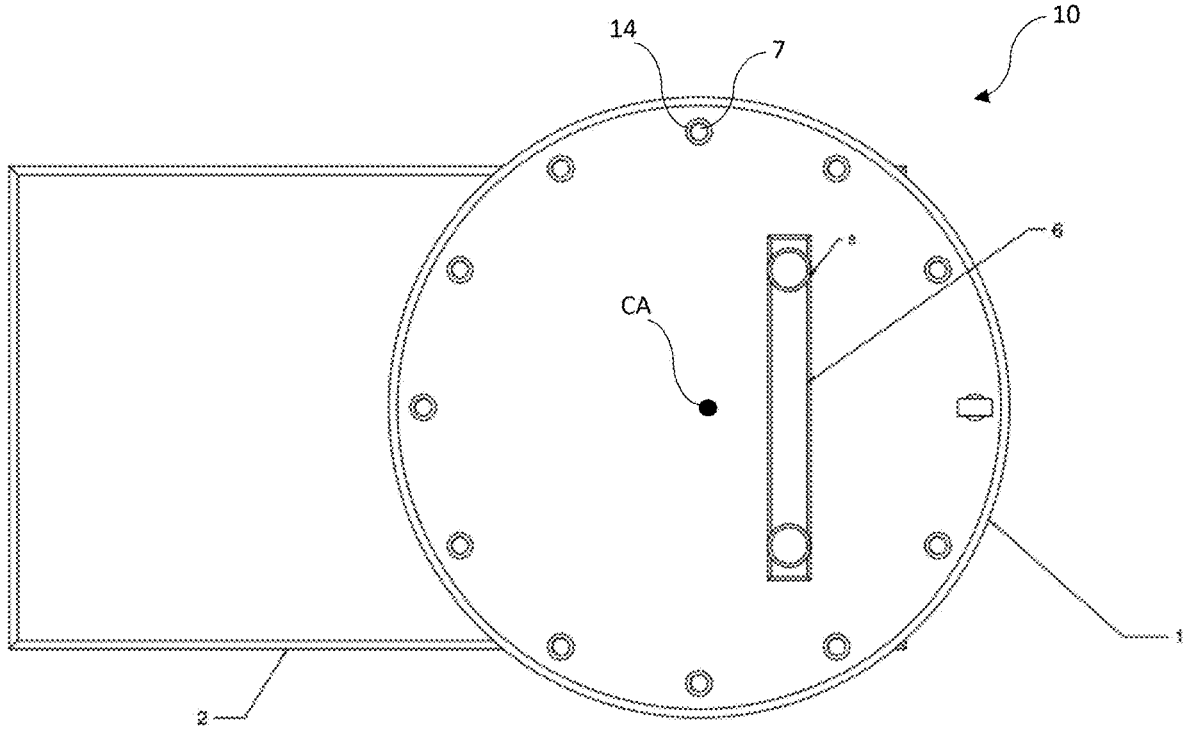
FIG. 2 illustrates a top view of the extremity resistance system of FIG. 1.

FIG. 2 illustrates a top view of system 10. A circular pattern to connect resistance bands 7 on the top platform 1 is mathematically equivalent to the pattern used on base 2, as will be discussed in greater detail below. Strap 6 allows the operator to secure their extremity, such as for example their foot or hand, to the top platform 1. The securing strap is comprised of a strap 6 and a strap securing mechanism 8 used to attach strap 6 to the top platform 1. Strap securing mechanism 8 can be any of a number of securing mechanisms, such as, for example, a screw fastener or a bracket. Strap 6 can be adjustable to ensure that the user's extremity is securely coupled with platform 1. Strap 6 can incorporate any suitable means for fattening, such as for example Velcro, a buckle, or rachets.

Resistance bands 7 are coupled with connection points 14 of platform 7. As illustrated, in some embodiments, bands 7 are coupled with strap holes 14 of platform 1. Bands 7 are removable from system 10 such that an end of each band 7 can be selectivity coupled and uncoupled with each connection point 14. Connections points 14 are disposed around the platform at equal distances from a center axis CA of the platform and at equal rotational intervals about the platform. For example, in the illustrated embodiment, there are twelve connection points 14 spaced substantial 30 degrees for the next connection point. Those with skill in the art will recognize that in some embodiments of this disclosure, there can be more or less than twelve connection points 14.

In some embodiment of this disclosure, the distance of each connection point 14 from the center axis CA of platform 1 can be adjustable. For example, as will be discussed below, the connection point 14 can be incorporated on a track system that allows the connection points distance from the center axis CA of platform 1 to be adjusted. In other embodiments, as will be discussed below, there are a plurality of connection points 14 at varying distances from the center axis CA.

Figure 3:
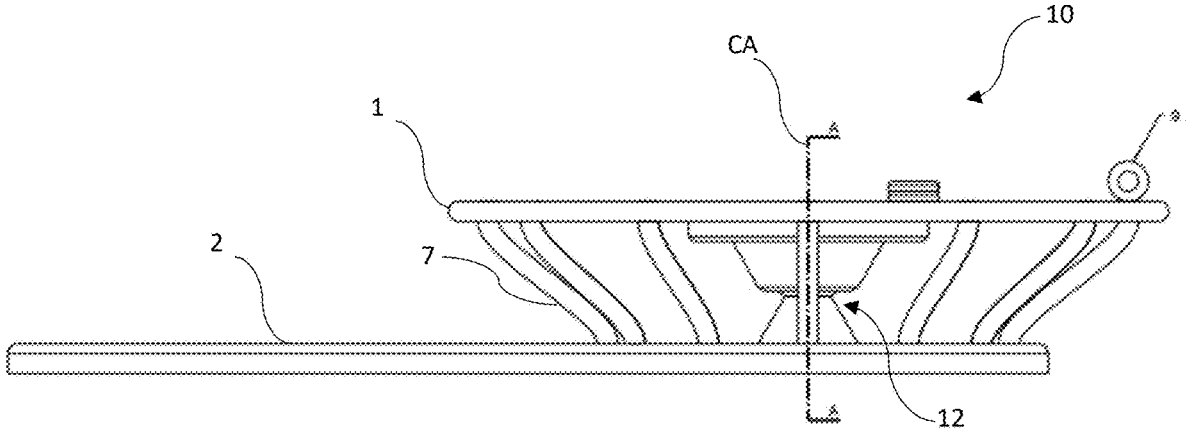
FIG. 3 illustrates a side view of the extremity resistance system of FIG. 1.

FIG. 3 illustrates a side view of system 10. Resistance bands 7 are positioned in a mathematically equal circular pattern surrounding the top platform 1. The resistance bands 7 can be locked into place or removed from the top platform quickly. FIG. 3 also illustrates joint 12 coupling platform 1 to base 2.

Figure 4:
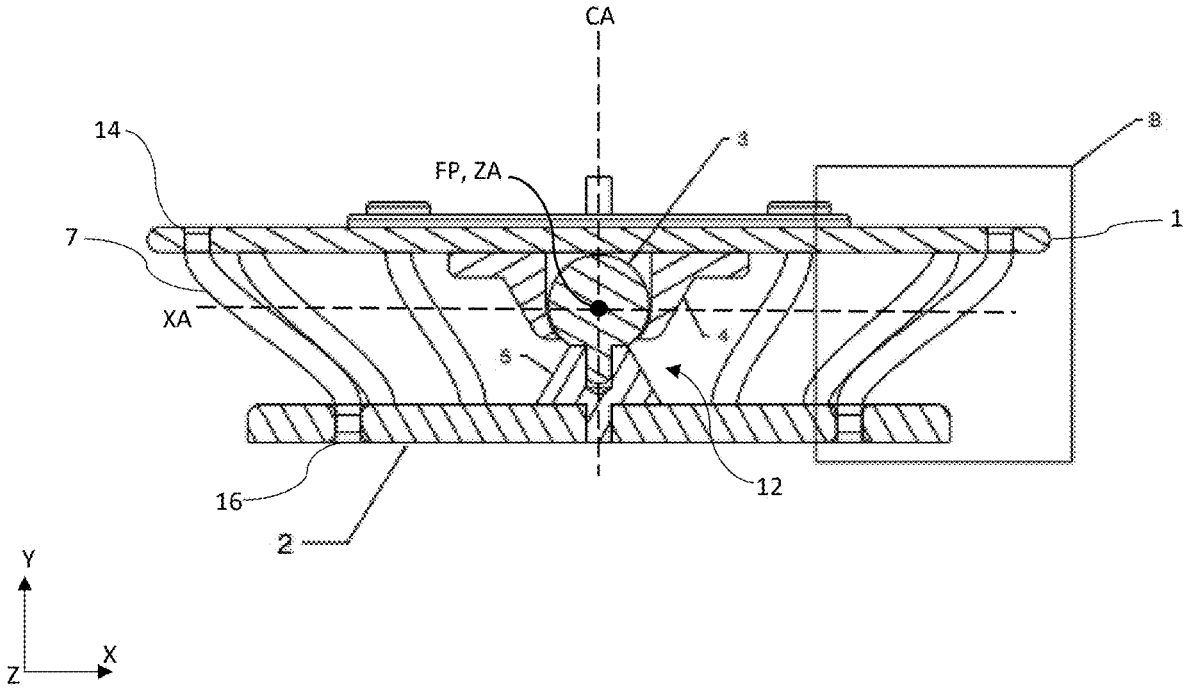
FIG. 4 illustrates a cross-sectional view taken along sectional line A-A of FIG. 3.

FIG. 4 is a cross-section view of FIG. 3 taken along line AA of FIG. 3 and illustrates the various components of joint 12, as well as base 2 and platform 1. The joint 12 acts as a fulcrum. One embodiment of joint 12 would be as depicted, with a volcano base 5 seated into the base 2. Where a spherical ball 3, capable of being seated inside the volcano base 5, rests inside an encasement socket 4. The encasement socket 4 can be comprised of two separate pieces that come together to form a housing for the spherical ball 3 to rest in. The encasement socket 4 is coupled to the bottom platform 1 and is centered by platform central axis CA. Accordingly, joint 12 can be described as ball-and-socket joint that allows for rotation in all three planes, as volcano base 5 and ball 3 are rotatably coupled with socket 4. Although the pictured embodiment illustrates that socket 4 is mounted to platform 1 and ball 3 and volcano 5 are mounted to base 2, those with skill in the art will recognize that in other embodiments of this disclosure, joint 12 is mounted in an orientation 180 degrees from what is illustrated. That is to say, in some embodiments of this disclosure, ball 3 and volcano base 5 are mounted to the bottom of platform 1 and socket 4 is mounted to the top of base 2.

Base plate 2 comprises a plurality of connection points 16 to which bands 7 are configured to connect. For each of the plurality of connection points 14, there is a corresponding connection point 16, wherein each connection point 16 is formed on substantially a same vertical plane as its corresponding connection point 14. Connection points 16 can be substantially the same as connection points 14 previously described in terms of form and functionality. As illustrated, connection points are disposed closer to platform central axis CA than connection points 14. This is done so that optimum resistance is provided by resistance bands 7 when in use. The illustrated embodiment has twelve connection points 16 formed in base 2, although those with skill in the art will recognize that in some embodiments of this disclosure, there can be more or less than twelve connection points 16. In some embodiments of this disclosure, the distance of each connection point 16 from the center axis CA of platform 1 can be adjustable, in substantially the same ways as described for connection points 14 above.

Those with skill in the art will understand movements made possible between bodies coupled by a ball-socket-joint, such as the joint 12. Socket 4 is rotatable in any direction about ball 3. Specifically, the center of ball 3 is the fulcrum point FP of joint 12 and socket 4 is rotatable in any direction about fulcrum point FP. For example, in the sectional view illustrated in FIG. 4, platform 1, through its connection with socket 4, is rotatable about a z-axis ZA (going into the page) passing through fulcrum FP so as to change the angle formed between platform central axis CA and a fulcrum x-axis XA that passes horizontally through fulcrum point FP. For example, if this motion could be achieved by a user placing their foot on platform 1 along the x-axis XA and flexing the toe-end portion of their foot downward or upward. Those with skill in the art will understand that axes XA and ZA are illustrative axes associated with the particular section view at which FIG. 4 is taken. Platform 1 is configured to be rotatable about a z-axis passing through fulcrum FP in any direction so as to change the angle between platform central axis CA and the associated x-axis corresponding to the direction in which platform 1 is rotated.

Further, joint 12 allows for platform 1 to be rotated about platform center axis CA, which passes through the fulcrum point FP. For example, to achieve this motion, a user can connect their foot to platform 1 and twist their foot left or right. Further, a user can rotate the platform about platform central axis CA and z-axis ZA simultaneously. For example, a user may flex the toe-end of their foot downward (rotate about z-axis ZA) and after or simultaneous with the downward toe-end motion, rotate their ankle (rotate about platform central axis CA). Said another way, those with skill in the art will understand that ball-and-socket joint 12 allows for rotation of platform 1 around the fulcrum point FP in all three planes. Said another way, platform 1 is able to rotate about the fulcrum point in the pitch, roll, and yaw dimensions.

The rotations about fulcrum point are resisted in all three planes by bands 7. For example, when the toe-end of the foot is flexed downward, bands adjacent to the heal-end of the user's foot are flexed and resist the downward flexing motion being performed by the user. For example, when the user twists their foot left or right about the central axis, each of the plurality of bands 7 may experience flexing and resist the twisting motion. Accordingly, by resisting the movements with bands 7, muscles of the extremity using system 10 are strengthened.

Although not illustrated, in some embodiments, the height of platform 1 is adjustable in the Y-direction. For example, in some embodiments, joint 12 is configured to extend and retract in the Y-direction to adjust the height of the platform. As illustrated, joint base 5 has a pin that is inserted into a corresponding hole of base 2 to mount joint base 5 to base 2. In some embodiments, spacer rings are placed in between joint base 5 and base 2 to variably adjust the height of platform 1. The spacer rings have a center hole that aligns with the hole of base 2 and in which the pin of joint base 5 is inserted. Spacer rings can be of varying thickness so that they can be used alone or in conjunction with other spacer rings to achieve a desired height of platform 1. The spacer rings can be secured to base 2 so that joint 12 is securely mounted to the spacer ring by pin of joint base 5 by only engaging the spacer ring and not having to additionally engage the hole of base 2 for stability. Accordingly, because the height of platform 1 is adjustable and rotatable about the fulcrum of joint 12, system 10 provides adjustable resistance with five degrees of freedom.

Figure 5:
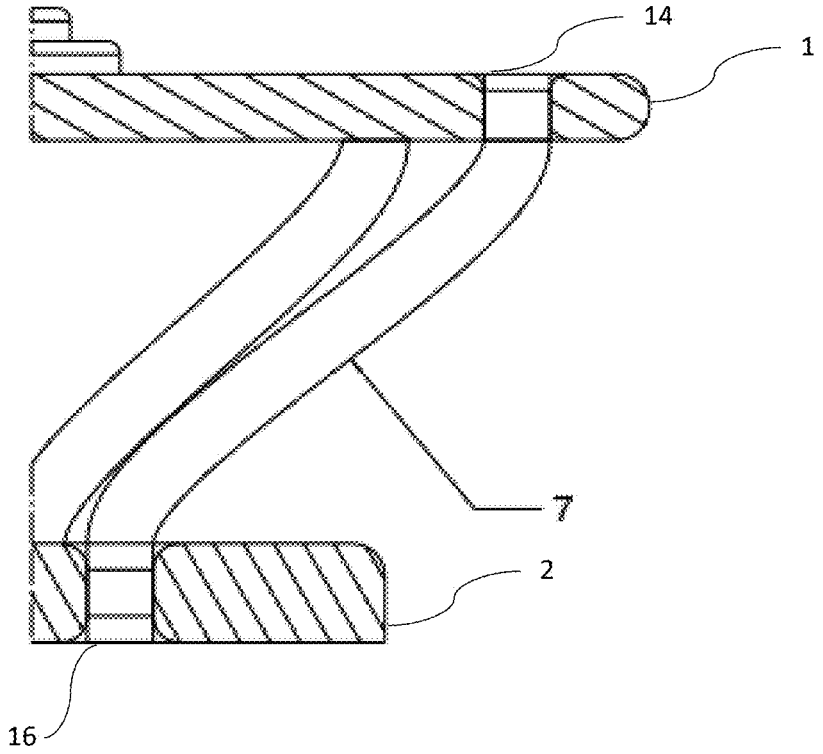
FIG. 5 illustrates a magnified view of a resistance band of the extremity resistance system of FIG. 4.

FIG. 5 is an enhanced view of section B of FIG. 4 and illustrates resistance band 7 and how it is attached to both the top platform 1 and the base 2. The resistance band 7 can be selectively coupled with each corresponding connection points 14, 16. As previously discussed, band 7 can also be unlocked from each connection point 14, 16 so as to removed from system 10. Bands 7 can be added or removed to system 10 to provide a desired resistance for a certain movement in which system 10 is be utilized at a given time. For example, a user may want to resist the downward flexing movement of the toe-end of their foot, but not resist any upward flexing movement of the toe-end of their foot. To achieve this, the user may remove bands 7 from system 10 that are adjacent to the toe-end of their foot, but leave bands 7 adjacent to the heal-end of their foot attached. In this position, downward movement of the toe-end of their foot will still be resisted by the bands 7 left in place, but upward movement of the toe-end of their foot will not be resisted by system 10, as the bands 7 required for such resistance have been removed. Those with skill in the art will understand that the disclosed example of resistance bands 7 removed is just one of numerous configurations in which bands 7 could be removed or adjusted to affect the resistance provided to the user's extremity.

Figure 6:
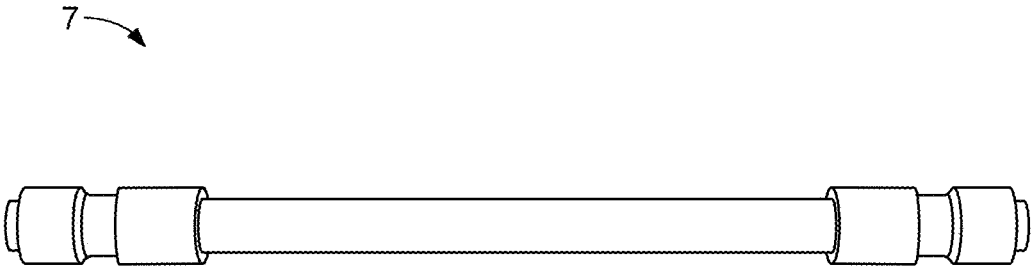
FIG. 6 illustrates a resistance band of an extremity resistance system, according to an embodiment of this disclosure.

FIG. 6 is one embodiment of a resistance band 7. Resistance band 7 comprises an elastic material to provide resistance. Differently sized and rated resistance bands can be used with system 10 to achieve more or less resistance. As previously discussed, each end of resistive band can be coupled and locked with connection points 14, 16.

Although not illustrated, other embodiments incorporate additional features to affect the resistance provided to the user. For example as will be discussed below, in some embodiments, the platform 1 further comprises connection points at which weights can be connected to the platform. Using the weight connection points, weights can be strategically coupled to platform 1 so that certain rotations about fulcrum point FP are provided additional resistance.

Additionally, some embodiments incorporate additional means for limiting the amount by which platform 1 can rotate about fulcrum point FP. In some embodiments, the rotation of the platform 1 can be limited by pinning the joint 12 to limit its ability to rotate about the fulcrum point FP. System 10 can include a mechanism or system that controls the range of motion of platform 1, such as removable stopper pegs disposed in base 2 that platform 1 would contact after rotating a certain amount about a horizontal axis passing though fulcrum point FP. Additionally similar pegs could be placed in base 2 to limit the amount by which platform 1 can rotate about platform center axis CA. One with skill in the art will recognize various situations in which it may be desirable to limit the rotation of platform 1 about fulcrum FP. For example, a patient may have just gotten out of surgery and can only do micro movements. The stopper pegs prevent overextending by the patient while still allowing them to use system 10. Motion can be gradually increased by swapping the pegs with shorter pegs, removing the pegs, or otherwise adjusting the mechanism controlling the range of motion. The stopper pegs are discussed in greater detail below when discussing FIG. 14. Other means of limiting rotation of the platform are discussed in greater detail below.

Figure 7:
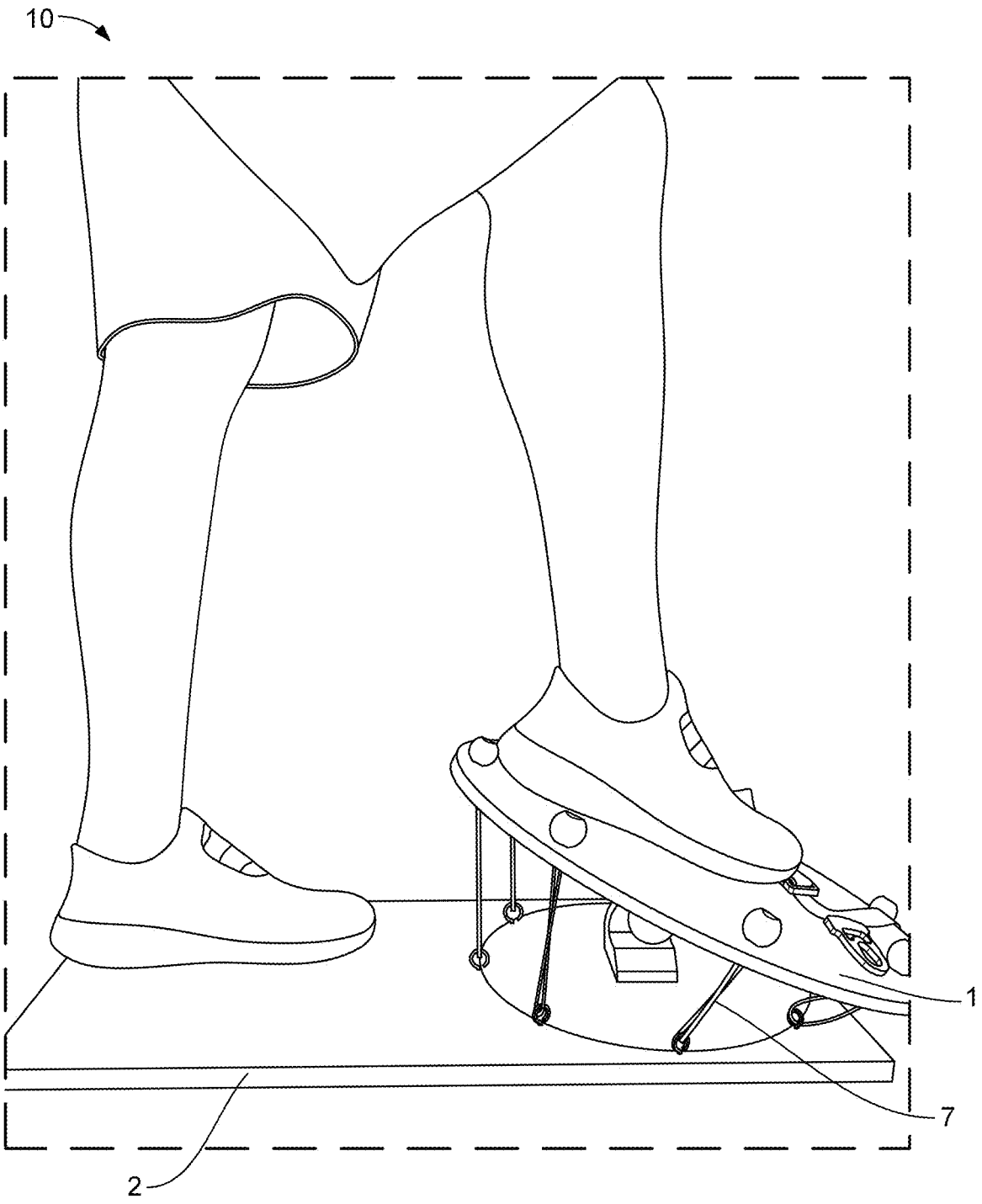
FIG. 7 illustrates a user using an extremity resistance system, according to an embodiment of this disclosure.

FIG. 7 illustrates a user using system 10 for strengthening exercises of their foot/ankle. As shown, the user's active foot performing the exercise is placed on the top of platform 1, while the user's other foot stands on base 2 to anchor system 10 when in use. In FIG. 7, the user flexes the toe-end of their active foot downward and platform 1 rotates about fulcrum FP of joint 12 accordingly. In this position, as illustrated, the bands 7 adjacent to the heal-end of the active foot are in tension and resist the downward movement of the toe-end of the foot. The bands 7 adjacent to the toe-end of the foot are slacked in response to the downward toe-end movement of the foot. In this position the user could also twist their active foot to rotate platform 1 about platform center axis CA, and bands 7 would resist that motion.

Figure 8:
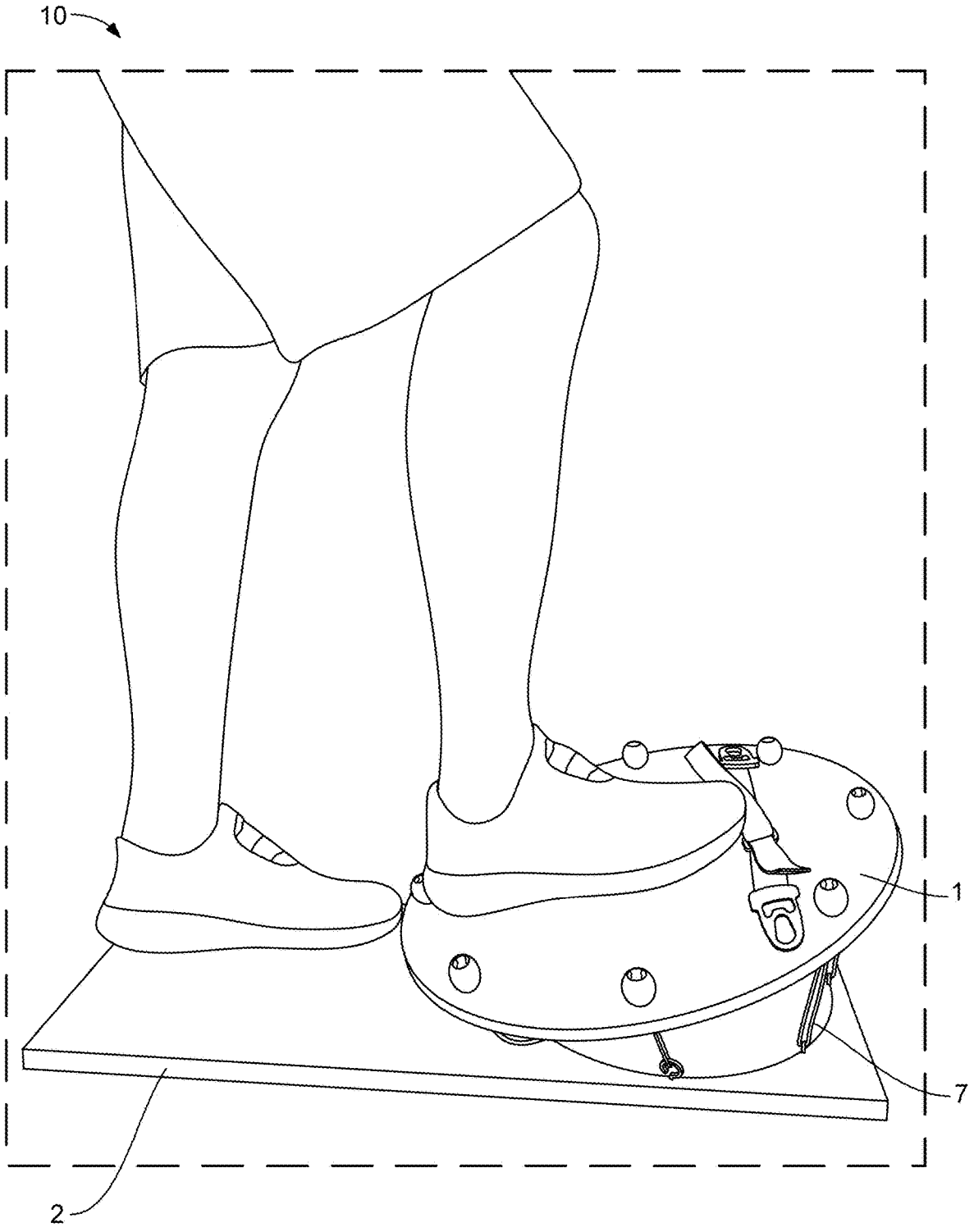
FIG. 8 illustrates a user using an extremity resistance system, according to an embodiment of this disclosure.

FIG. 8 illustrates a user using system 10 for strengthen exercises of their foot/ankle. As shown, the user's active foot performing the exercise is placed on the top of platform 1, while the user's other foot stands on base 2 to anchor system 10 when in use. In FIG. 8, the user flexes the toe-end of their active foot upward and platform 1 rotates about fulcrum FP of joint 12 accordingly. In this position, as illustrated, the bands 7 adjacent to the toe-end of the active foot are in tension and resist the upward movement of the toe-end of the foot. The bands 7 adjacent to the heal-end of the foot are slacked in response to the upward toe-end movement of the foot. In this position the user could also twist their active foot to rotate platform 1 about platform center axis CA, and bands 7 would resist that motion.

FIGS. 7 and 8 are merely exemplary representations of how system 10 can be used and are included to show how a user would use the system 10 with their lower extremities. One with skill in the art will understand that any of numerous movements can be performed by the user using system 10.

Figure 9A:
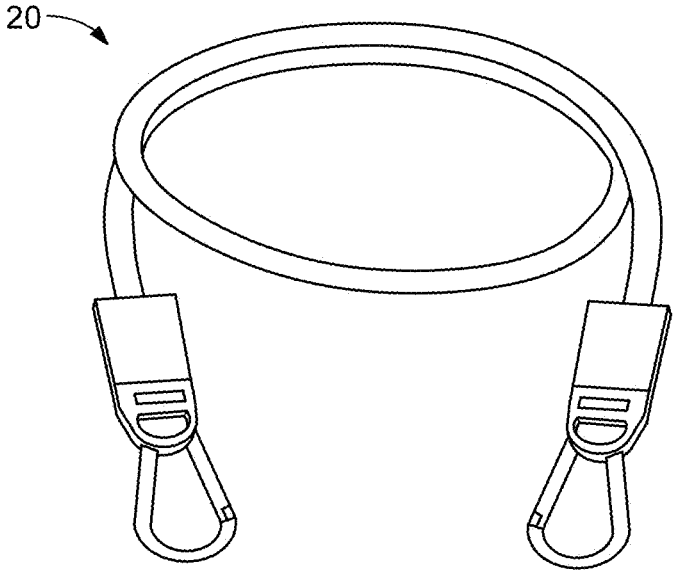
FIGS. 9A-9C illustrate various embodiments of resistance bands, according to various embodiments of this disclosure.
Figure 9B:
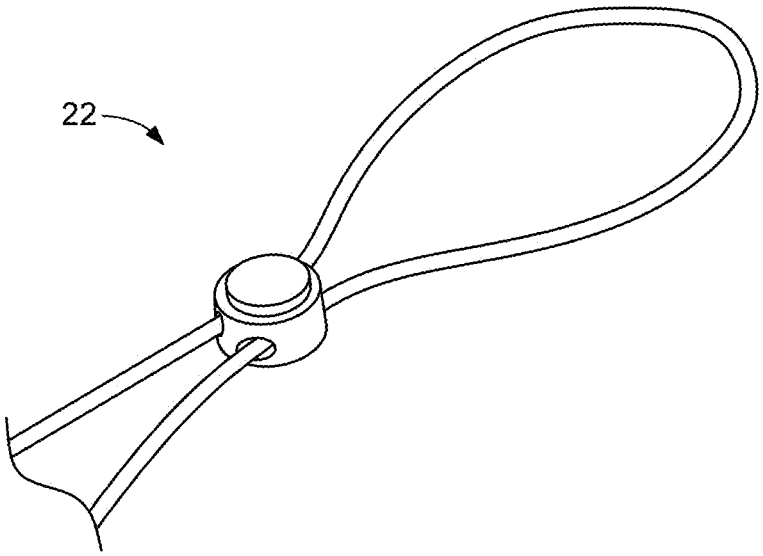
Figure 9C:
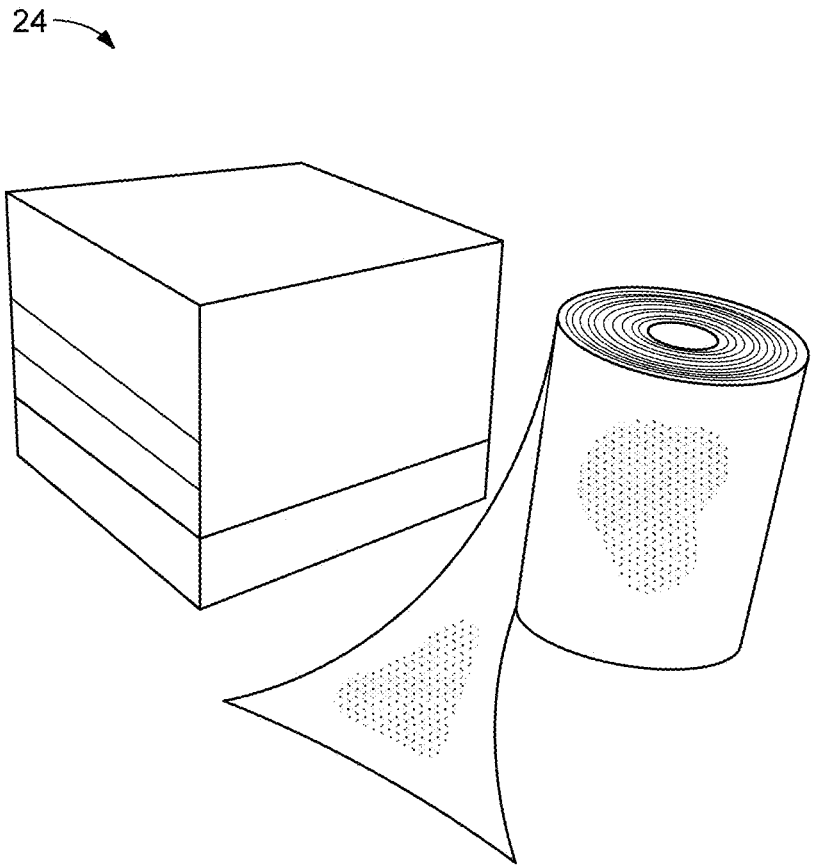

FIGS. 9A-9C illustrate different embodiments of resistance bands that can be used in various embodiments herein. The resistance bands in 9A-9C can be substantially the same as resistance band 7 previously described. FIG. 9A illustrates a carabiner band 20 which is an elastic band with carabiner or hook connection points on each end. FIG. 9B illustrates a drawstring band 22 which has an elastic band that can be adjustably drawn and locked into place with a drawstring button. FIG. 9C illustrates a resistance band roll 24 which is an elastic band that can be cut from the roll at a desired length.

Figure 10:
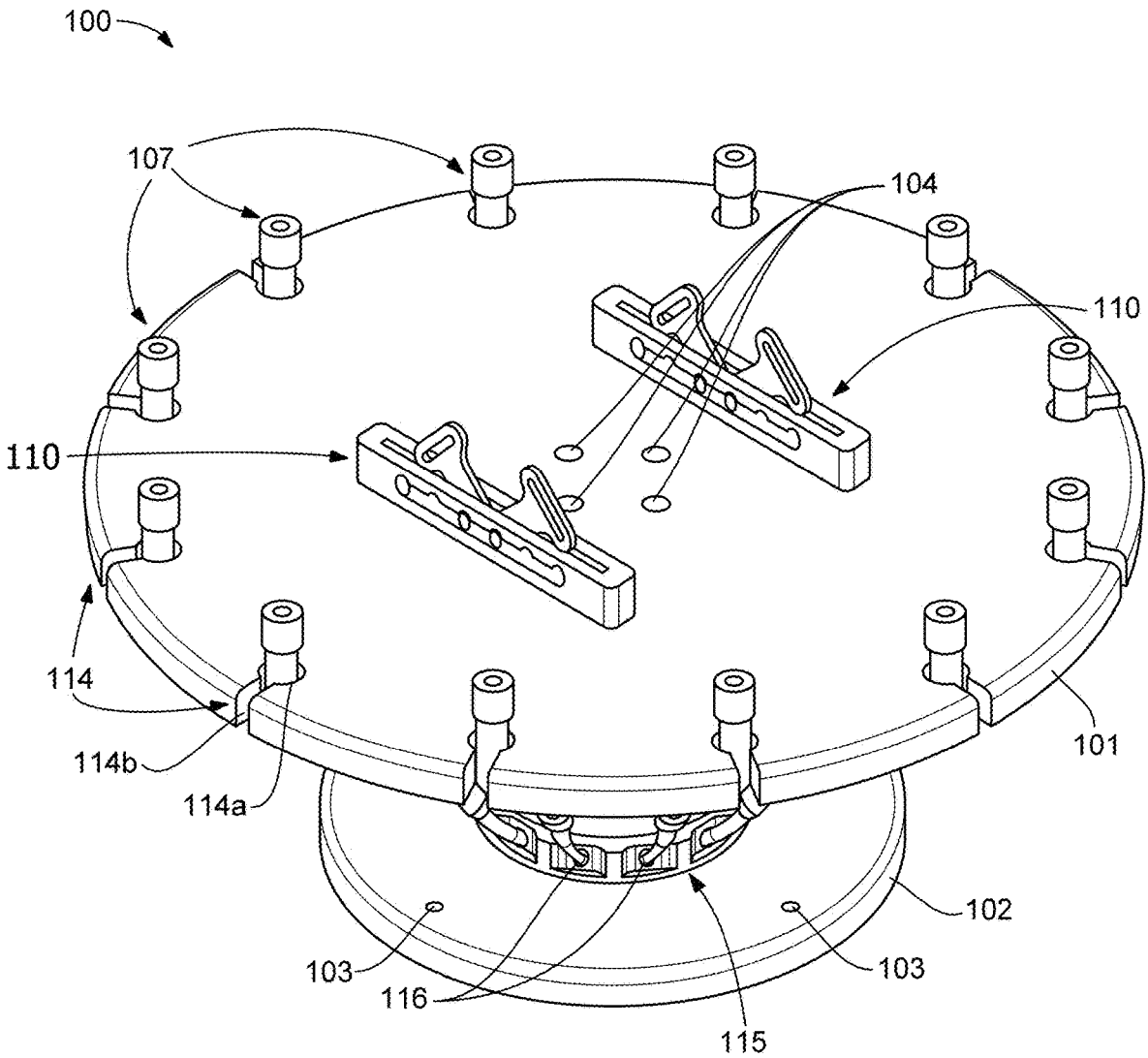
FIG. 10 illustrates a perspective view of another extremity resistance system, according to an embodiment of this disclosure, according to another embodiment of this disclosure.

FIG. 10 illustrates a perspective view of an extremity strengthening system 100, substantially similar to the system 10 previously discussed. Those with skill in the art will understand the similarities between system 10 and system 100, and in an effort to reduce redundancy, new and different features of system 100 will be primarily discussed below. System 100 can be used in substantially the same ways as system 10 discussed above. System 100 includes a platform 101 (substantially similar to platform 1) and a base 102 (substantially similar to base 2) coupled to each other by a joint 112 (substantially similar to joint 12), and a plurality of elastic resistance bands 107 (substantially similar to elastic resistance bands 7). As shown in FIG. 1 base 102 further includes a plurality of through holes 103 through which fasteners, such as screw for example, can be passed to secure the base 102 to the floor or another surface. System 100 further includes fasteners 104 which couple the platform 101 to joint 112, as can be better understood in FIG. 13. Although four fasteners 104 are shown, those with skill in the art will understand that system 100 includes more or less than four fasteners, according to various embodiments of this disclosure. Platform 101 further includes two extremity strap brackets 110 through which a strap, such as strap 6 for example, can be coupled and the brackets 110 and strap can be used to secure the user's desired extremity to the platform 101.

Platform 101 further includes a plurality of platform connection points 114 (substantially similar to connection points 14) and base 102 further includes a plurality of base connection points 116 (substantially similar to connection points 16). As will be discussed in greater detail below, points 114 are slots formed in an outer circumferential edge of platform 101, and in which a top end of resistance band 107 is configured to be coupled by seating the top end of the resistance band 107 in the slot. Each slot 144 has a passage section 114*b* formed in the outer circumferential edge of platform 101 and a stopper seat 114*a* in which a stopper of resistance band 107 is seated. As will be discussed in greater detail below, points 116 are through-holes formed on a raised ring 115 of base 102 through which a hook or clasp of band 107 is coupled by being inserted though the through-hole.

Although system 100 is illustrated and described as including twelve resistance bands 107, those with skill in the art will understand that system 100 can include more or less than twelve resistance bands 107 without departing from the scope of this disclosure. Further, as been discussed above, system 100 can be used without coupling all twelve resistance bands 107 with base 102 and platform 101. For example, to provide a desired resistance in all three planes to a user using system 100, certain resistance bands 107 can be selectively removed and/or added to system 100. In some embodiments, each of resistance bands 107 are uniform in the resistance force or strength each provides to platform 101. However, in some embodiments, resistance bands 107 have differing resistance forces or strengths. One inventive aspect of this disclosure is that resistance bands 107 can be selectively removed and/or replaced to provide a desired resistance in all three planes to the user.

Figure 11:
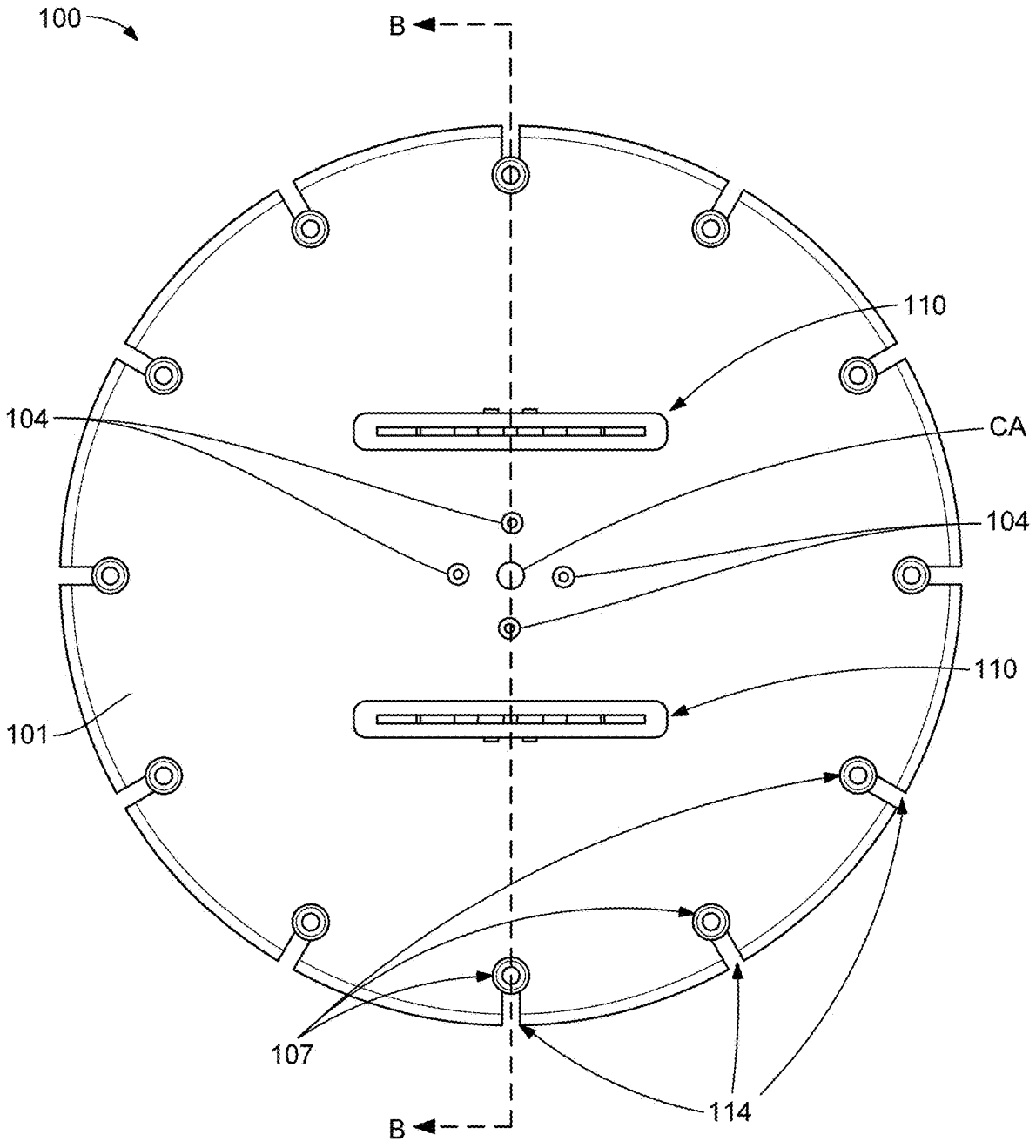
FIG. 11 illustrates a top view of the system of FIG. 10.

FIG. 11 illustrates a top view of system 100. From FIG. 11, the coupling of each resistance band 107 with connection point 114 can be better understood. As shown, each connection point 114 comprises a slot formed through a thickness of platform 101 and formed along an outer circumferential edge of platform 101. Each band 107 is radially, relative to central axis CA, inserted into slot 114, from an outside of platform 101 inward, and is seated in slot 114. The structure of slots 114 and resistance bands 107, as well as the coupling between the two, will be discussed in greater detail in FIG. 13, which is a cross-sectional view taken along cross-section BB shown in FIG. 11.

Figure 12:
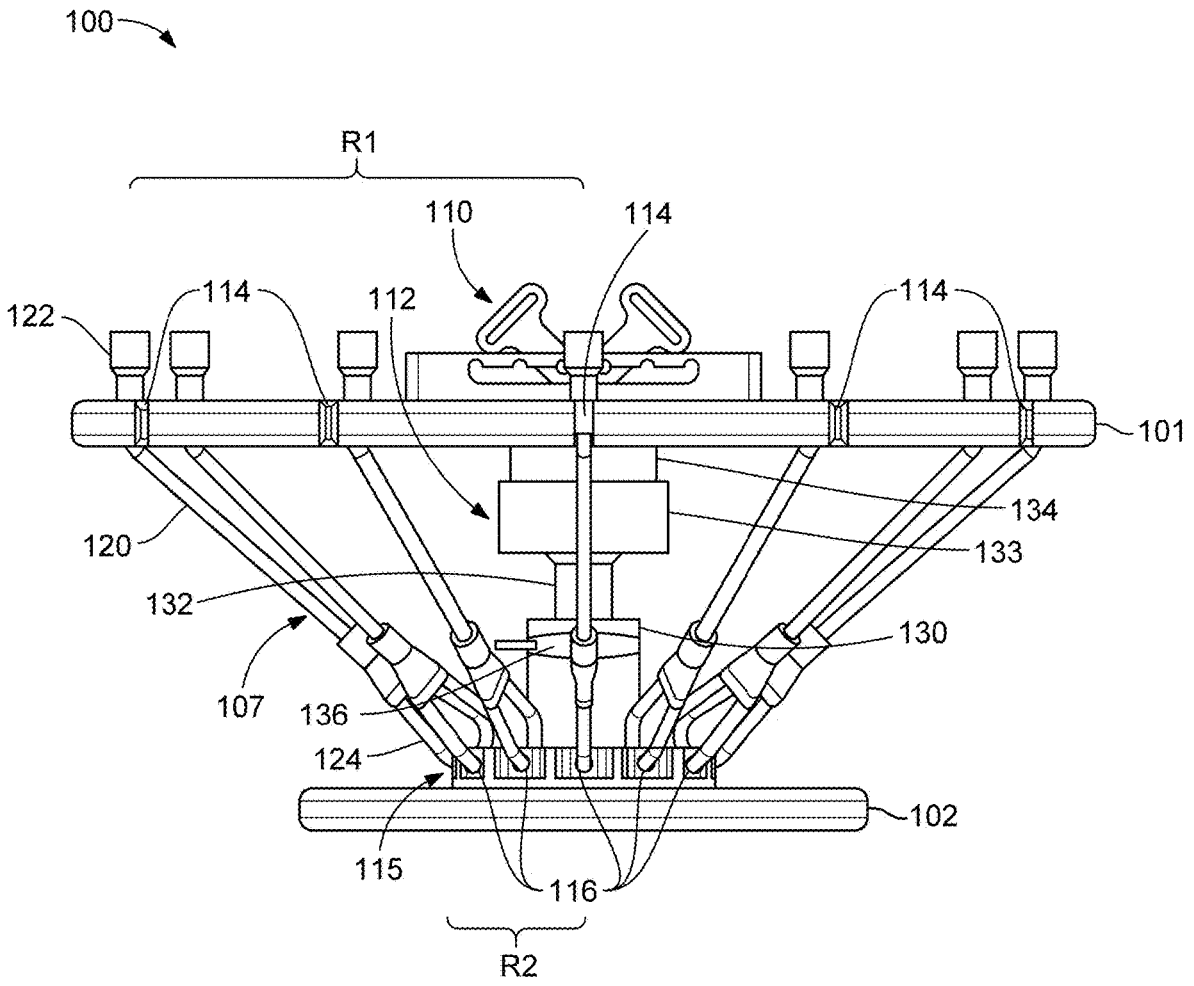
FIG. 12 illustrates a side view of the system of FIG. 10.

FIG. 12 illustrates a side view of system 100. Base 102 includes a raised ring 115 that is raised from a top surface of base 102 and centered around the joint 112. As illustrated, the raised ring 115 includes the plurality of base connection point 116, which are each a through hole that passes through a radial thickness of the ring 115. Each of the elastic resistance bands 107 includes a middle elastic section 120, a stopper 122 disposed on a first end of the elastic section 120 and configured to be coupled with platform connection point 114, and a hook 124 disposed on a second end of the elastic section 120 and configured to be coupled with base connection point 116. Those with skill in the art will recognize that hook 124 can comprise any of a number of hook types without departing from the scope of this disclosure. For example, in some embodiments, hook 124 is has simple hook structure, such as a classic "fishhook" structure, for example. In other embodiments, such as the embodiment illustrated, hook 124 can further include a locking arm that ensure the hook won't slide off of connection point 116, such as a carabiner hook or a spring snap hook or link, for example. In some embodiments, system 100 includes multiple rings 115 each centered about joint 112 and each with different diameters. In such embodiments, a user is able to engage a connection point 116 at a desired distance from joint 112, and thus adjust the force applied to rotations of platform 101 by the resistance band 107.

While system 100 illustrates that platform 101 has slot-type connection points 114 connectable with stopper 122, and that base 102 has hole-type connection points 116 connectable with hook 124, those with skill in the art will understand that other embodiments are included within the scope of this disclosure. For example, in some embodiments, instead of or in addition to slot-type connection points 114, platform 101 can have a ring with through-hole connection points, substantially similar to ring 115 and holes 116, disposed on a bottom surface of platform 101 facing base 102 and connectable with a hook of band 107. The through hole connection points can be disposed at a same radial position as where points 114 are shown and described—that is to say, at an outer circumferential edge of platform 101. Further, in some embodiments, instead of or in addition to hole-type connection points 116, base 102 can have slot-type connection points, substantially similar to slots 114, connectable with a stopper of band 107. The slot-type connection points can be disposed at a same radial position as where points 116 are shown and described—that is to say, adjacent to joint 112. Accordingly, in some embodiments, resistance bands 107 can include a stopper 122 on each end, and in some embodiments, resistance bands 107 can include a hook 124 on each end. Those with skill in the art will recognize that connection points 114, 116 can comprise any various known methods of coupling, including the various coupling methods described herein, for example.

As was discussed with system 10, in system 100, each of the plurality of connection points 114 are disposed at a radial distance R1 from a center axis of system 100 that is greater than the radial axis R2 from the center axis at which each of the plurality connection point 116 are disposed. In some embodiments, this configuration is preferred in the resistance force vector applied to the platform by bands 107. However, those with skill in the art will understand that other embodiments are included within the scope of this disclosure. For example, in some embodiments, R1 is equal to R2. Still, in some embodiments, R2 is greater than R1.

Joint 112 is a ball-and-socket joint. Joint 112 includes a sleeve 130 coupled to base 102, a ball element 132 seated in sleeve 130, a socket 134 coupled to platform 101 and engaging ball element 132, and a coupling 133 coupling the socket 134 and ball element 132. As will be discussed in greater detail below, joint 112 is also configured to have an adjustable height, and has a pin 136 configured to couple the sleeve 130 and the ball element 132 to set a height of joint 112. Although joint 112 is shown as a ball-and-socket joint, those with skill in the art will understand that other joints, or combination of joints, can couple base 102 with platform 101 without departing from the scope of this disclosure.

Figure 13:
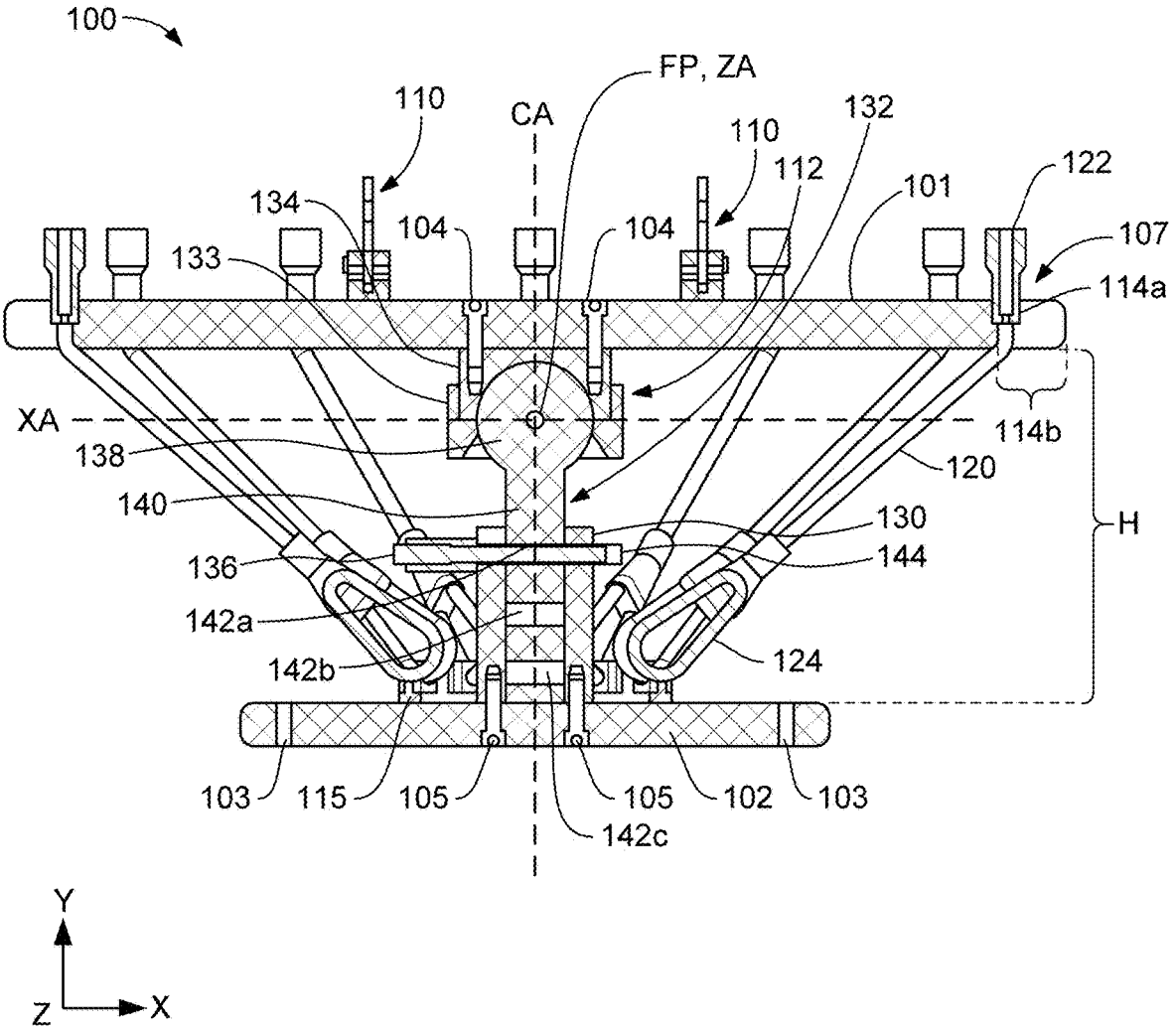
FIG. 13 illustrates a cross-sectional view of the system of FIG. 10.

FIG. 13 illustrates a cross-sectional view of system 100 taken along line BB illustrated in FIG. 11. FIG. 13 shows fasteners 104 which couple platform 101 to socket 134. Similarly, fasteners 105 couple base 102 to sleeve 130. Also shown are through-holes 103, through which screws or other fasteners are used to couple base 102 with the ground, floor, or other desired surface. Although base 102 and platform 101 are shown as being fastened to joint 112 with screws, 104, 105, those with skill in the art will understand that base 102 and platform 101 can be adhered to joint 112 any of a number of ways. For example, in some embodiment, base 102 and platform 101 can be welded, glued, taped, press-fitted, joined by dowel pins, or otherwise bonded with joint 112. Still in other embodiments, base 102 and platform 101 are integrally formed with parts of joint 112. For example, in some embodiments base 102 and sleeve 130 are integrally formed as a single piece, and/or platform 101 and socket 134 integrally formed as a single piece. Although system 100 illustrates that socket 134 is coupled to platform 101 and sleeve 130 is coupled to base 120, in other embodiments, socket 134 is coupled to base 102 and sleeve is coupled to platform 101.

As describe in system 10, in system 100, and as shown in FIG. 13, for each of the plurality of connection points 114, there is a corresponding connection point 116, wherein each connection point 116 is formed on substantially a same vertical plane as its corresponding connection point 114.

As previously discussed, an overall height H of joint 112 is adjustable. As shown in FIG. 13, ball element includes a ball 138 configured to engage socket 134 and a stem 140 configured to be seated in sleeve 130. Stem 140 has a plurality of through holes 142*a*, 142*b*, 142*c* each of which can be aligned with a through-hole of sleeve 144. Pin 136 is configured to pass through sleeve through-hole 144 and engage one of the stem through holes 142*a*-142*c* to couple to stem 130 with the sleeve 140 and also set the height H of joint 112. Those with skill in the art will understand that the joint 112 has a greatest height H when hole 142*c* is engaged by pin 136, and a shortest height H when hole 142*a* is engaged by pin 136. Accordingly, joint 112 is configured to have a variable height H, and by adjusting the joint height H, a user can adjust the distance between base 102 and platform 101. Those with skill in the art will understand that by adjusting the height, and thereby adjusting fulcrum point FP, the resistance force applied by bands 107 to platform 101 is changed. Thus, a user may adjust the amount of resistance provided against movement by simply adjusting the joint height H, rather than changing the types of bands 107 used. This allows for further refinement of the system 100 in providing desired resistance in all three planes when operating system 100. A user is configured to us an extremity to rotate platform 101 about fulcrum point FP relative to axes XA, ZA in the same way previously discussed with system 10.

As previously mentioned, each stopper 122 is coupled with a point 114 by being seated in seat 114*a*. Referencing FIGS. 10 and 13, for each slot 114, seat 114*a* has a circular cross-section slightly larger than the cross-section of the proximal end of stopper 122 such that stopper 122 is configured to be inserted and seated in seat 114*a*. As shown, the width of the seat 114*a* is greater than the width of passage section 114*b*, such that, once seated in seat 114*a* and held in place via downward bias provided by elastic portion 120, stopper 122 is firmly seated in seat 114*a* and there is no potential for stopper 122 to dislodge into passage 114*b*. The width of passage 114*b* is sized such that only elastic portion 120 can be passed through passage 114*b*. Thus, to seat stopper 122 in seat 114*a* and thus couple stopper 122 with point 114, the elastic portion 120 must radially (relative to center axis CA) be inserted into passage section 114*b* from an outside of platform 101 to seat 114*a*. The stopper 122 can then be seated into seat 114*a* and held in place by the bias applied to the stopper by elastic section 120.

Figure 14A:
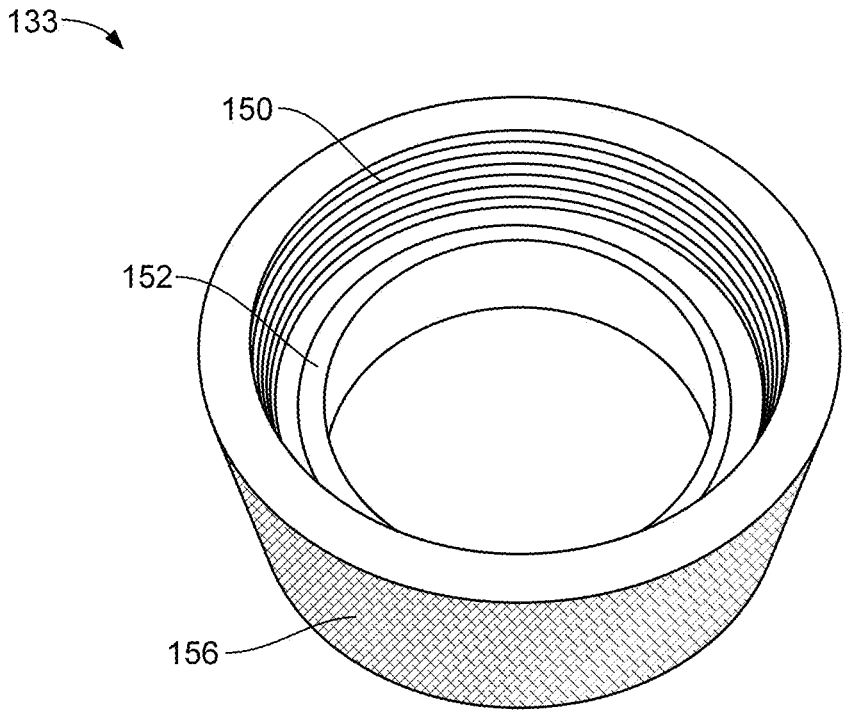
FIGS. 14A and 14B illustrate perspective top and bottom views, respectively, of a joint coupling, according to an embodiment of this disclosure.
Figure 14B:
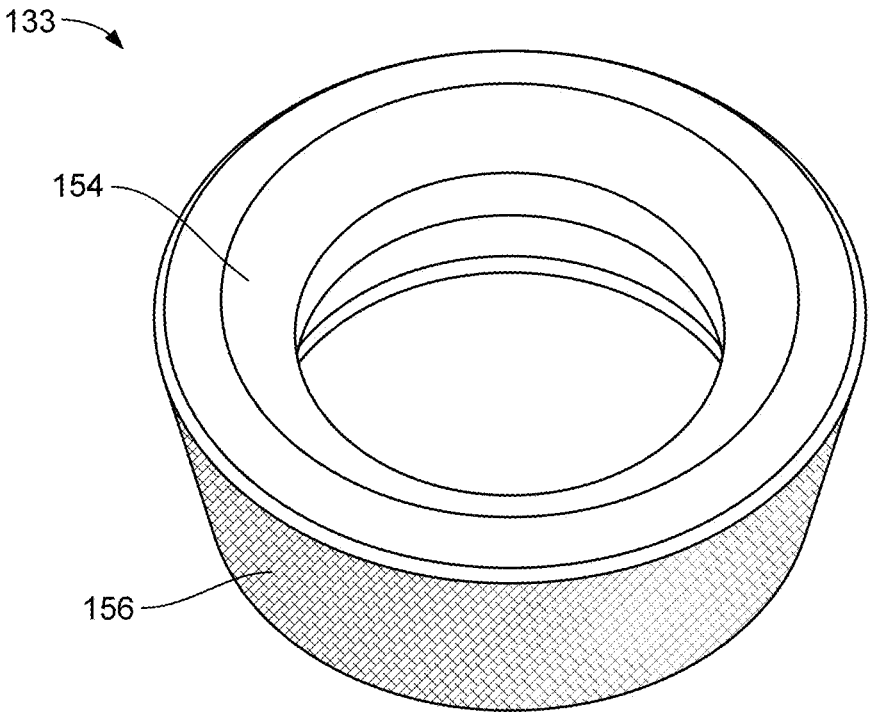

FIGS. 14A and 14B are perspective top and bottom views, respectively, of coupling 133. As previously discussed, coupling 133 is configured to operatively couple ball 138 with socket 134. In some embodiment, coupling 133 includes interior threads 150 configured to be mated with corresponding exterior thread of socket 134 to couple coupling 133 with socket 134. Coupling 133 has a seat surface 152 configured to seat against a bottom surface of socket 134 when the coupling 133 and socket 134 are fully engaged. When coupling 133 and socket 134 are fully engaged, ball 138 is secured between coupling 133 and socket such that it cannot be moved downward past seat 152. That is to say, the inner diameter of seat 152 is large enough to pass around stem 140, but is smaller than the outer diameter of ball 138 such that ball 138 is secured against socket 134 when socket 134 and coupling 133 are fully engaged. Coupling 133 comprises a bottom surface 154 configured to engage against ball 138 and/or stem 140 when platform 101 is rotated about axis XA—that is to say, when platform 101 is rotated in the pitch and roll directions. Thus, bottom surface 154 defines and limits the amount of rotation capable by platform 101 about axis XA. Said another way, those in the art will recognize that coupling 133 is configured to limit and define the pitch and roll capable by platform 101, but is not configured to effect the yaw of platform 101. As illustrated in FIGS. 13 and 14B, in some embodiments, bottom surface 154 comprises a concave bevel, and thus allows for a relatively large degree of rotation about axis XA. In other embodiments, in situations where less rotation about axis XA is desired, a coupling 133 with a flat bottom surface 154 can be used to further restrict rotation about axis XA, as a flat bottom surface would sooner engage ball 138 and/or stem 140 when rotated about axis XA. In other embodiments, in situations where even less rotation about axis XA is desired, a coupling 133 with a convex bottom surface 154 can be used to even further restrict or entirely eliminate rotation about axis XA, as a convex bottom surface 154 would even sooner engage ball 138 and/or stem 140 when rotated about axis XA.

Accordingly, system 100 can include various couplings 133 interchangeable within the system 100, and can be changed out based on a desired rotation about axis XA. For example, in situations in which a large rotational range about XA is desired, a user can incorporate a coupling with ae concave bevel bottom surface 154. For example, in situations where a more limited range of motion is desired, a coupling 133 with a less concave or a flat bottom surface 154 can be used. Those with skill in the art will recognize various scenarios in which less range of motion about XA is desirable. For example, a user may be using system 100 to recover a severe ankle injury where she is only permitted to make small or micro movements with her ankle. Thus, rotation XA can be limited by the coupling 133 chosen so that she can strengthen her ankle with small, safe, movements and not have to worry about accidentally over-extending her ankle and causing further harm. Couplings 133 can be swapped out for other ones allowing more and more movement about XA (and thus, more pitch and roll) as her ankle continues to strengthen. In situations where even less or no rotation about axis XA is desired, an operator can incorporate a coupling 133 with a convex bottom surface 154. Those with skill in the art will recognize various scenarios in which less motion about XA is desirable. For example, a user can use system 100 as a shoulder strengthening device and engage device by grasping opposing sides of platform 101 (i.e., hands in the 3 o'clock and 9 o'clock positions) in a push-up position. The user can then rotate platform 101 about central axis CA (i.e., like turning a steering wheel) with the platform locked with respect to axis XA. Thus, the user can focus his strength training to his arms and shoulders by rotating platform about axis CA without having to worry about tilt along the XA axis, which would throw him off balance. In some embodiments, as illustrated, coupling 133 includes a roughened outer surface 156 so that the outer surface can be easily grasped by a user in coupling/uncoupling coupling 133 with socket 134.

Figure 15:
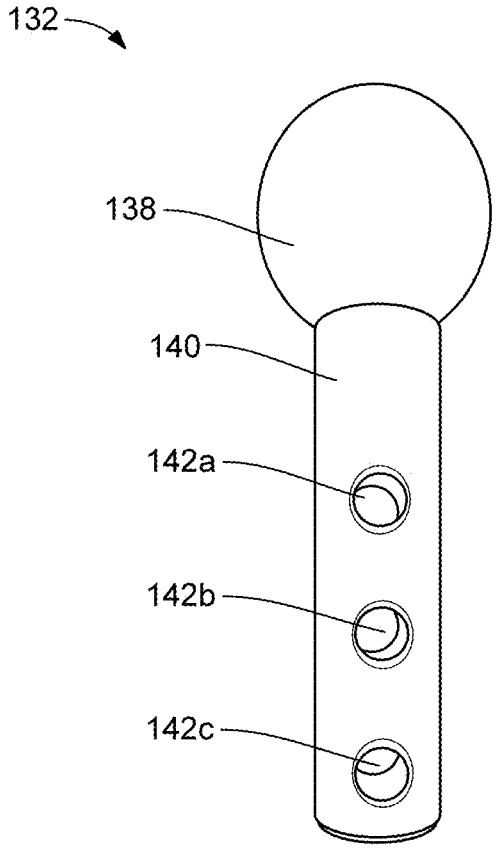
FIG. 15 illustrates a side view of a joint ball element, according to an embodiment of this disclosure.

FIG. 15 illustrates a side view of ball element 132, illustrating ball 138, stem 140, and through holes 142*a*-142*c*.

Figure 16A:
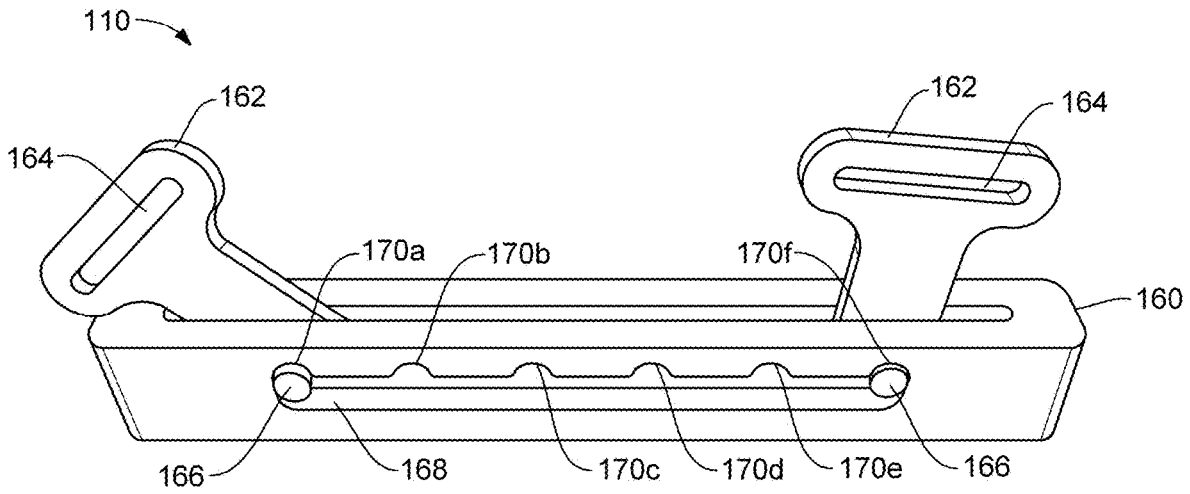
FIGS. 16A and 16B illustrate side views of a strap bracket assembly, according to an embodiment of this disclosure.
Figure 16B:
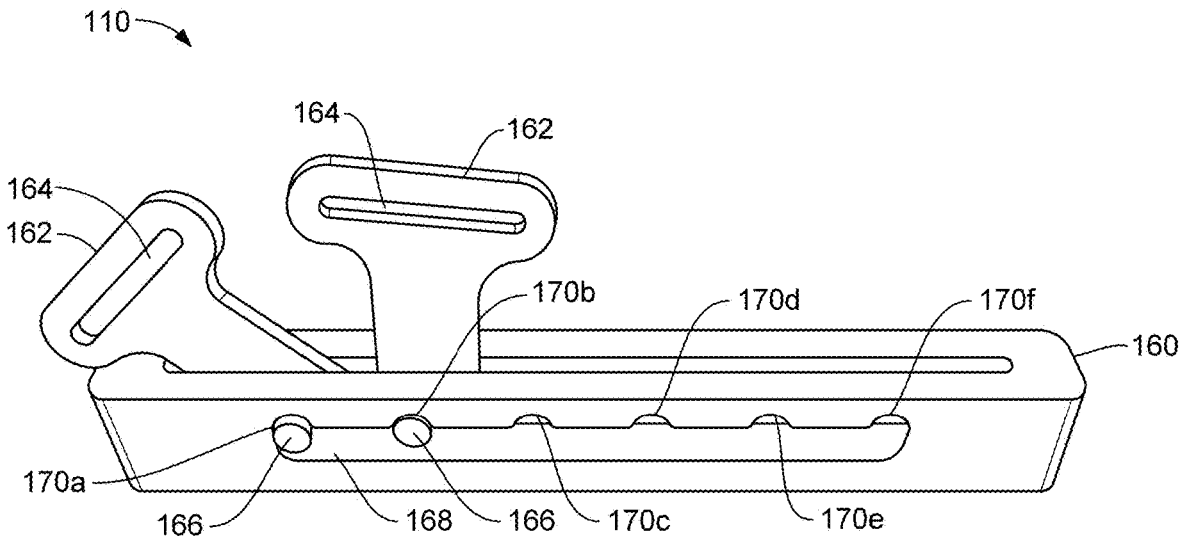

FIGS. 16A-B illustrate side views of bracket assembly 110. Each bracket 110 includes a base 160 and two strap holders 162. Each holder 162 has slot 164 through which a strap 6 can be passed and be coupled with the corresponding holder 162 of the other bracket 110. Each holder 162 has a pin 166 about which the holder 162 can be rotated, and by which the holder 162 is coupled with base 160. Base 160 includes a travel channel 168 in which holders 162 are movably coupled. Each pin 166 is biasedly seated by an internal spring force in a notch 170*a-f* of channel 168. Thus, each holder can be selectively positioned within channel 168 to a desirable position according to the user's extremity engaging the device 100. For example, in FIG. 16A, one holder 162 is shown disposed in notch 170*f*. To move the holder 162 to notch 170*b*, as shown in FIG. 16B, the user would press down on holder 162, against the bias force, to move pin 166 from notch 170*f* to channel 168. The user would then, while still pushing down on holder 162, slide holder 162 over so that pin 166 is positioned under notch 170*b*, and then release the holder 162 so that the bias force would engage pin 166 in place in notch 170*b*. As mentioned, once in position, each holder 162 can be rotated about a center axis of pin 166 to optimally position the holder 162.

Figure 16C:
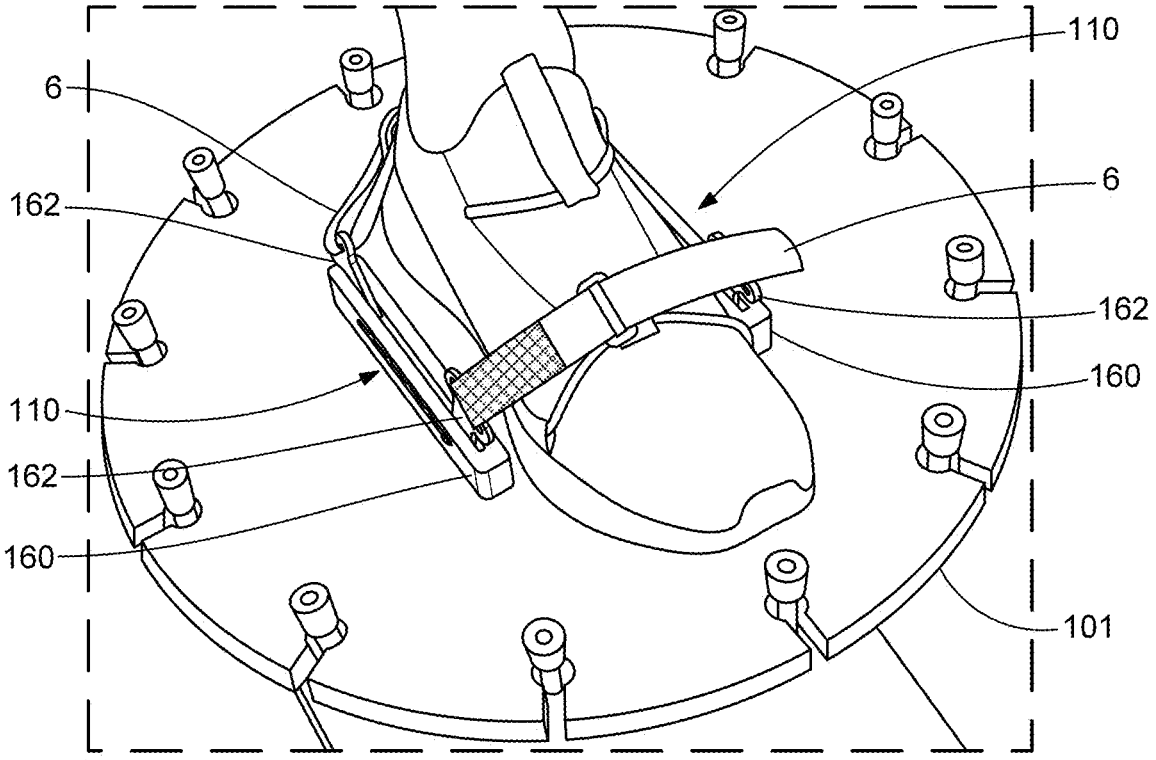
FIG. 16C is a perspective view illustrating a user's foot secured to an extremity resistance system, according to an embodiment of this disclosure.

FIG. 16C illustrates an embodiment in which a user's foot is secured to platform 101 using bracket assembly 110 and straps 6.

Figure 17:
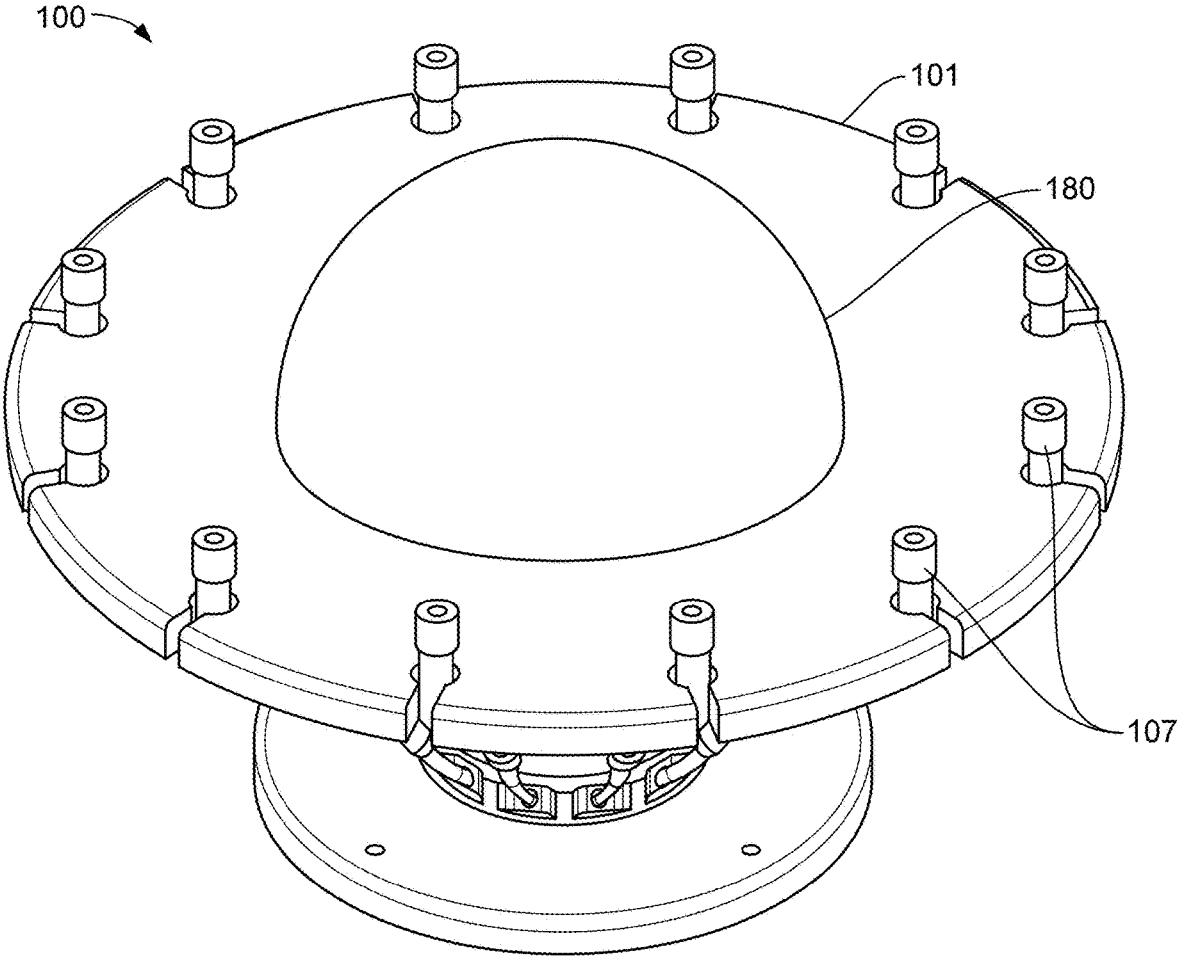
FIG. 17 illustrates a perspective view of an extremity resistance system including a hand grip piece, according to an embodiment of this disclosure.

FIG. 17 illustrates a system 100 with an additional hand grip 180 installed. As has been discussed, in some embodiments, system 100 can be used by placing the palm of a hand directly on platform 101, and optionally further strapping the hand to platform 101 using straps 6 and brackets 110. However, in some instances, it may be desired and more ergonomic for the hand or hands to be positioned in a gripped or semi-circular shape when using device 100. Accordingly, in some embodiments, a hand grip 180, which as shown can be a generally dome-shaped structure, is coupled to platform 101. A user's hand or hands is/are meant to engage system 100 by gripping an outer surface of hand grip 180. While grip 180 is shown as being generally dome-shaped in structure, other embodiments fall within the scope of the disclosure. For example, in some embodiments, the grip includes finger and thumb grooves in which a user can position their fingers and thumb to better and more ergonomically grip hand grip 180. Also, in some embodiments, a restraining device, such as brackets 110 and straps 6, can be used in conjunction with grip 180 to ensure the users hand is firmly held in place. In some embodiments, grip 180 can be installed on platform 101, while in other embodiments, the grip 180 is integrally formed with its own platform that can be coupled to joint 112 and bands 107.

Figure 18:
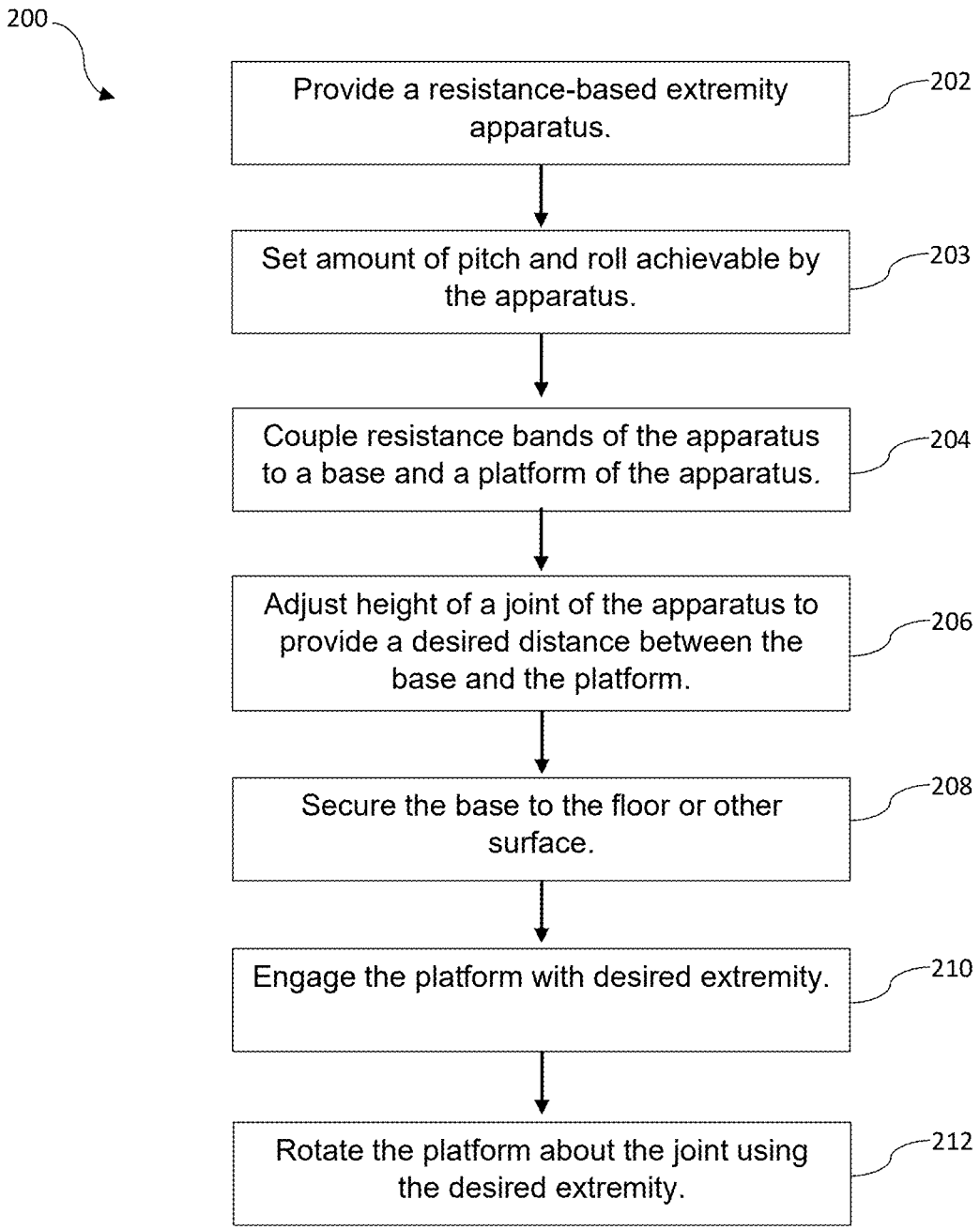
FIG. 18 is a flowchart illustrating a method for providing resistance-based extremity strengthening, according to an embodiment of this disclosure.

FIG. 18 is a flowchart illustrating a method 200 of providing a resistance-based training or strengthening to a user. Method 200 starts at block 202 by providing a resistance-based extremity strengthening apparatus, such as devices 10 and 100, for example. Method 200 can optionally continue at block 203 by, while assembling system 10, 100, setting an amount of pitch and roll achievable by platform 1, 101. For example, as previously discussed, in some embodiments this can be done by assembling the joint 112 with a coupling 133 that limits the pitch and roll movement of platform 101 by a desirable amount. As previously discussed, system 100 can include multiple couplings 133 each configured to limit rotation of platform 101 by a different amount based on the structure of the bottom surface 154 of the coupling 133, and block 203 can include assembling joint 112 with a desired one of the couplings 133 according to a desired amount of pitch and roll of platform 101 for a given strengthening exercise. Method 200 can continue to block 204 by coupling resistance bands 7, 107 of the device 10, 100 to the platform 1, 101 and base 2, 102 according to the coupling methods discussed herein. Block 204 can include coupling one, some, or all of the plurality of resistance bands 7, 107 to the base 2, 102 and platform 1, 101 based on the desired resistance to be applied by bands 7, 107 to the user operating the device 10, 100, as has been described. Method 200 can optionally continue at block 206 by adjusting a height of joint 112 according to the methods discussed herein, and thereby adjusting a distance between platform 101 and base 102. As has been previously discussed, the height of joint 112 can be adjusted to provide for a desired resistance to be applied by bands 7, 107 to the user operating the device 10, 100, and also provided a desired distance between base 2, 102 and platform 1, 101. Method 200 can optionally continue at block 208 by securing base 2, 102 to the floor or another surface. For example, as discussed above, in some embodiments this includes the user placing an extremity, such as their foot, on base 2 and standing on base 2 and thus securing the base 2 in place on the floor. In other embodiments, this includes the user passing screws or fastener through holes 103 of base 102 to secure base 102 to the floor or another surface. In other embodiments, device 100 can be secured to the floor simply by the user engaging the platform 1, 101 in combination with the weight of the device 10, 100. The method can continue at block 210 by the user engaging the platform 101 with their extremity, which can include optionally include using strap 6 or backet 110 and strap 6, as discussed herein to secure the extremity. In other embodiments, block 210 can include grabbing a part of the platform, such as grip 180. Method 200 can continue at block 212 by the user rotating the platform 1, 101 about the joint 12, 112, fulcrum point FP in any of or all three planes, as has been discussed, where the rotation is resisted by the plurality of elastic resistance bands 7, 107.

In some embodiments, the desired extremity of method 200 is the user's foot and the foot rotating the platform 1, 101 about the fulcrum point FP of the joint 12, 112 strengthens tendons, muscles, and/or joints of the user's leg and/or foot by the resistance provided to the platform 1, 101 by resistance bands 7, 107. In some embodiments, the desired extremity of method 200 is the user's hand and the hand rotating the platform 1, 101 about the fulcrum point FP of the joint 12, 112, strengthens tendons, muscles, and/or joints of the user's hand, arm and/or shoulder by the resistance provided to the platform 1, 101 by resistance bands 7, 107. However, those with skill in the art will recognize that other embodiments are included within the scope of this disclosure and that other extremities can engage device 10, 100 to strengthen tendons, muscles, and/or joints associated with the extremity.

Although method 200 illustrates blocks 202-212 occurring in a certain order, those with skill in the art will recognize that blocks 202-212 can be performed according to various orders without departing from the scope of this disclosure. Further, method 200 can be performed using less than all of steps 202-212, or even with additional steps, without departing from the scope of this disclosure.

Figure 19:
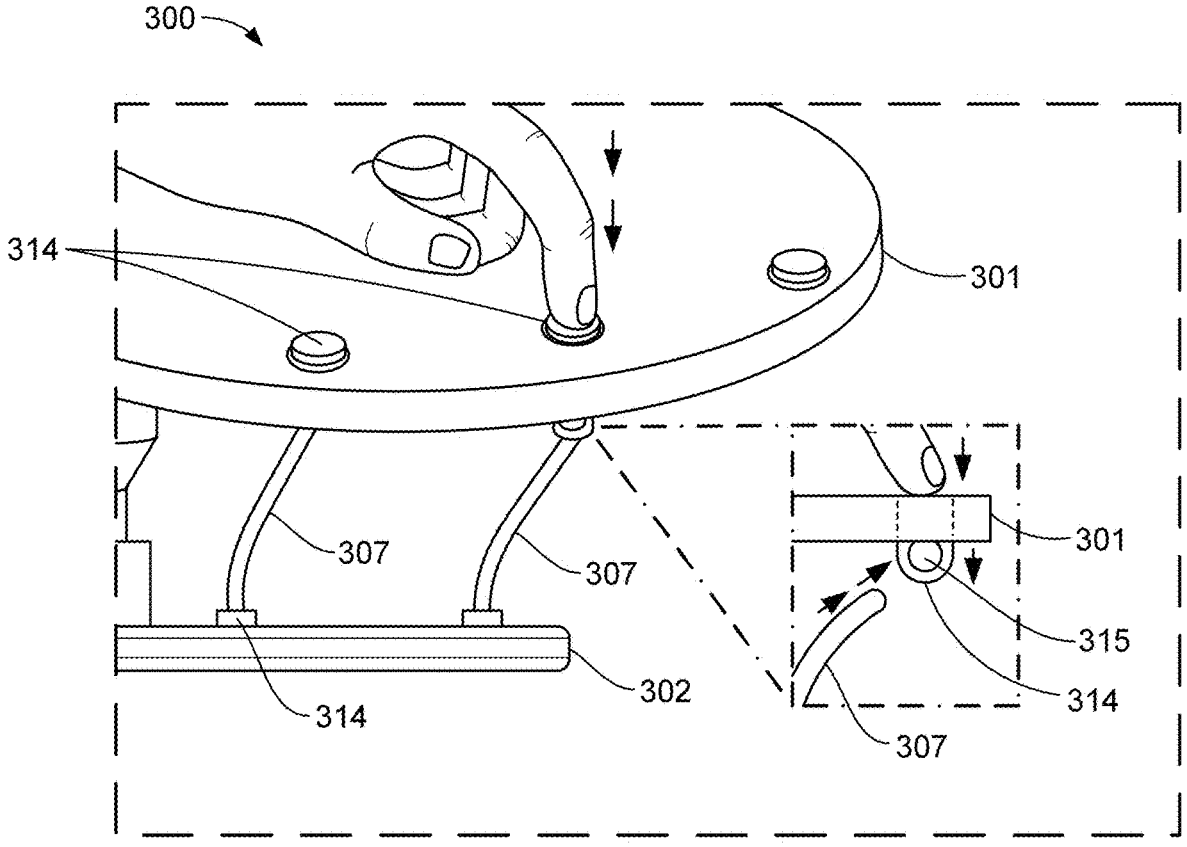
FIG. 19 illustrates another embodiment of an extremity resistance system with push-button resistance bands, according to an embodiment of this disclosure.

FIG. 19 illustrates an embodiment of a resistance training system 300 substantially the same as resistance systems 10, 100. The system has a base 302 substantially the same as base 2, 102 and a platform 301 substantially the same as platform 1, 101. The system incorporates resistance bands 307 with no end attachments. In some embodiments, resistance bands with a circular cross-sectional area are used. In some embodiments, resistance bands from band roll 24 are used. The platform 301 and base 302 have push-down connection points 314 which clamp the resistance band 307 into place against the respective platform 301 or base 302. Looking at the platform 301, the connection points 314 have a hole 315 in which and end of the resistance strap 307 is placed. In some embodiments, the push-down connection points 314 are spring-loaded buttons that bias the connection point 314 in a way such that the band hole is positioned within the platform 301. When the button 314 is pushed, the hole 315 is accessible from a bottom side of the platform 301 so that a resistance band 307 can be engaged or disengaged with the strap hole 315. When the button 314 is released, the band hole 315 goes back up to its position within the platform 301 and the band 307 is then secured in place. Although a connection point 314 of the platform 301 is illustrated, one with skill in the art will understand that in some embodiments the same connection point 314 is incorporated into the base 302.

Figure 20A:
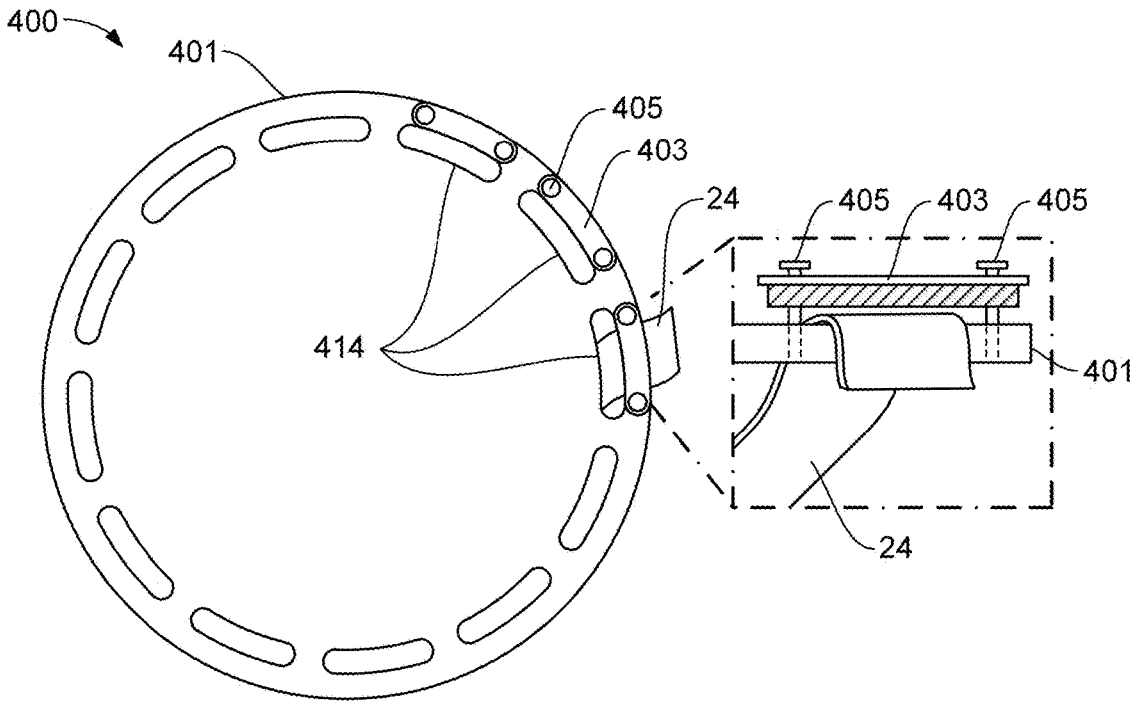
FIGS. 20A and 20B illustrate another embodiment of an extremity resistance system with a resistance band connection point track system, according to an embodiment of this disclosure.
Figure 20B:
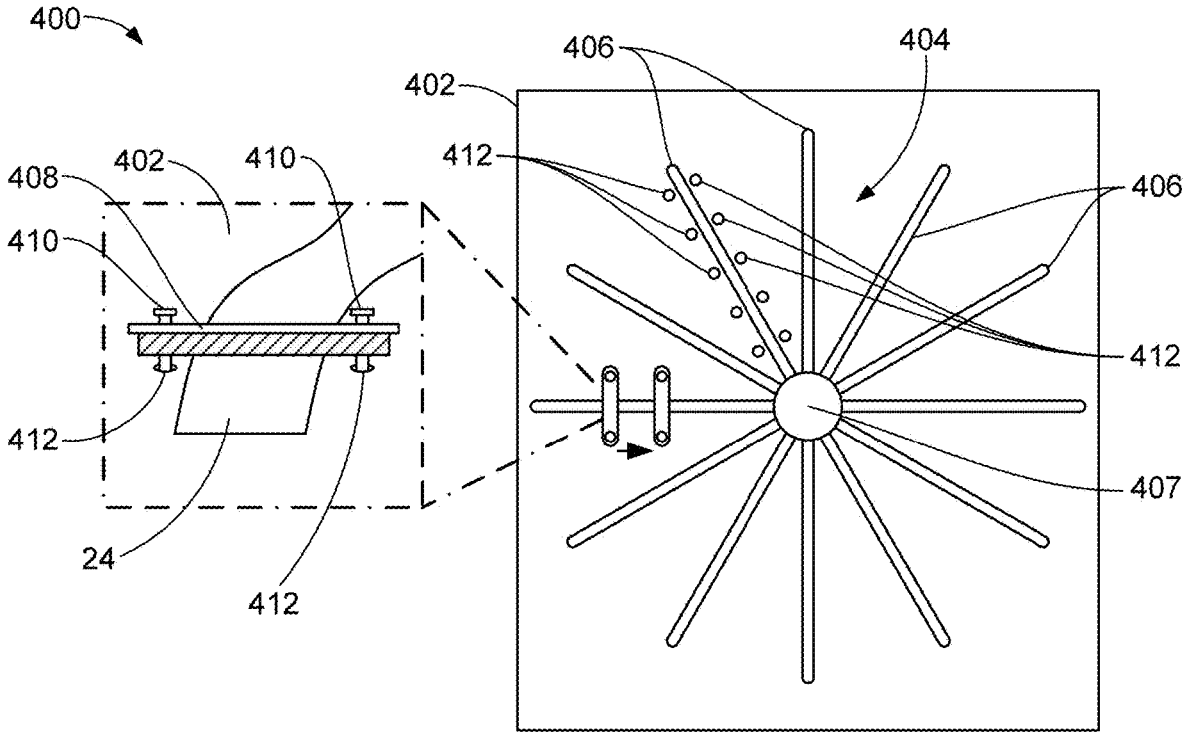

FIGS. 20A and 20B illustrate an embodiment of a resistance training system 400, substantially the same as resistance systems 10, 100. The system 400 has a base 402 substantially the same as base 2, 102 and a platform 401 substantially the same as platform 1, 101. The system incorporates a track system 404 on the base 402 in which the location of the connection points of the base 402 can be changed. Additionally, the system 400 allows for the tension in the resistance bands 24 used to be variable. The platform 401 has a plurality of through-hole slots 414 through which the resistance bands 24 are passed. On the top of the platform 401, a rod 403 and screws 405 secure the band 24 in place against the top of the platform 401. As shown, in some embodiments screws 405 are used to secure the rod and to the platform 401 and clamp the resistance band 24 against the platform 401. By using this type of connection point, the band 24 can be adjusted to a desired length. In some embodiments rods 403 are made of rubber, although those with skill in the art will understand that other materials fall within the scope of this disclosure. Accordingly, the system can incorporate variable resistances according to a desired training method.

Similarly, rod 408 is clamped to the base, in some embodiments via screws 410, to secure the resistance bands 24 to the base 402. The distance of each connection point from a center joint 407 is adjustable along a track system 404. In some embodiment, the track system 404 incorporates a plurality of slots or tracks 406 extending radially from the joint 407 and along which the rod 408 can be engaged. There are a plurality of screw hole 412 points at varying distances from the joint 407 along the track 406 with which the screws 410 of the rod 408 can engage. Accordingly, the band 24 can be connected to the base 402 by rod 408 clamping band 24 against base 402 at varying distances from the joint 12, and thus form a band 24 connection point with base 402, according to a desired training method.

Figure 21:
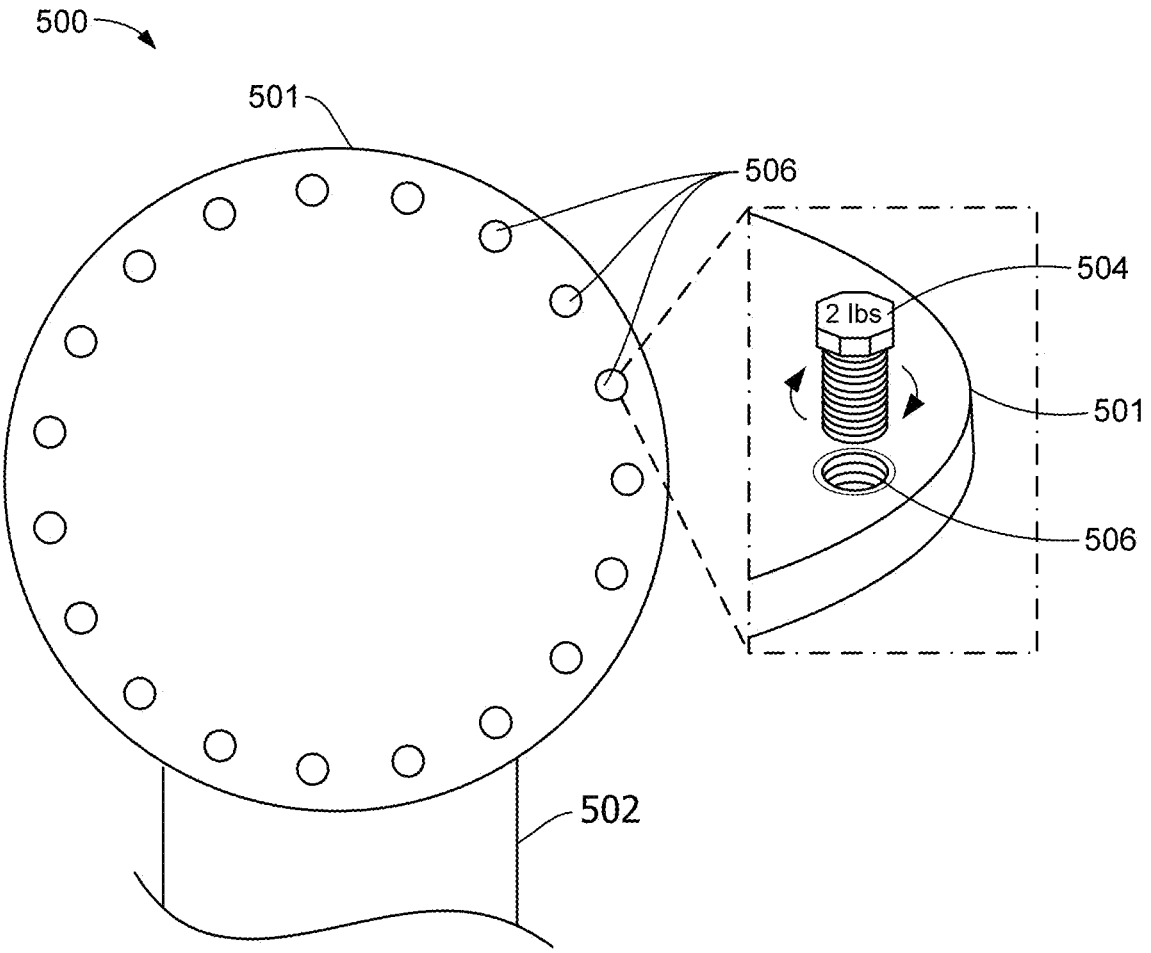
FIG. 21 illustrates another embodiment of an extremity resistance system with an adjustable joint with mountable weight members, according to an embodiment of this disclosure.

FIG. 21 illustrates an embodiment of a resistance training system 500 substantially the same as resistance systems 10, 100. The system has a base 502 substantially the same as base 2, 102 and a platform 501 substantially the same as platform 1, 101. The system incorporates weighted members 504 that can be coupled to the platform at any of a plurality of platform weight connection points 506 to further resist or encourage rotation of the platform 501 about the joint fulcrum point. In some embodiments, as illustrated, the weight member 504 is a custom-made item in the shape of the screw with external treads configured to be engaged with corresponding internal threads of the connection points 506. As illustrated, the screw-weight 504 is a two-pound weight, however, various weight members of various mass/weight can be incorporated in other embodiments. The screw-weight 504 is coupled with a corresponding mating female connection point of the platform connection point 506. Accordingly, the screw-weight 504, or multiple screw weights 504, can be mated and screwed into place with any of the various mating connection points 506 according to a desired training program.

Although the base 2, 102 and platform 1, 101 have been described as being at different elevations, in various embodiments of this disclosure the base 2, 102 is raised to be at the same elevation as the platform 1, 101. In these embodiments, both of the user's feet would be at a same level while the system is in use. In some embodiments, the base includes a box that elevates the top surface of the base 2, 102 to the height of the top surface of the platform 1, 101. In some embodiments, the base 2, 102 is built to be the same height as the platform 1, 101. In other embodiments, the base 2, 102 is at a higher elevation than the platform 1, 101.

As previously discussed, system 10, 100 can be used for hand and wrist exercises. A user can use system 10, 100 to exercise their hand/wrist by positioning themselves in a push-up, all-fours, or crawling position, where the active hand, or both hands, is/are placed on platform 1, 101 In other embodiments, an inactive hand is placed on base 2, 102 to anchor the system 1. However, it is understood that other position can be taken by the user to utilize system 10, 100 for hand/wrist exercises. For example, the system 10, 100 can be placed on a table and the user could sit or stand and engage the system 10, 100. Further, embodiments of this disclosure can be used for strengthening any of a number of parts of the human body, such as, for example, calves, hamstrings, quadriceps, knees, hips, torso, forearms, biceps, triceps, shoulders, or neck.

In some embodiments, anchoring the system 10, 100 using the user's body weight is not required. For example, in some embodiments, base 2, 102 can be smaller than platform 1, and is configured to be secured to floor or another flatform so that anchoring by the user is not required. Or, as mentioned, in some embodiment the user's weight combined with the weight of the system 10, 100 is enough the secure the system 10, 100 in place during use without additional anchoring required.

Those with skill in the art will understand that systems 10, 100, 200, 300, 400, 500 are all substantially the same, and that certain differing features are focused on within this disclosure to avoid redundancy. Those with skill in the art will understand that various unique components of systems 10, 100, 200, 300, 400, 500 are interchangeable within others of the systems 10, 100, 200, 300, 400, 500.

The following describe just some of the numerous modes of implementation of system 10 to provide a better understanding of system 10:

1) Ankle range of motion: In one embodiment, the operator will place a foot in the securing strap on the top platform and move through all planes of motion without resistance bands (dorsiflexion, plantarflexion, abduction, adduction, inversion, eversion, supination, and pronation).
2) Ankle range of motion with resistance: (eccentric and concentric contraction). The following are descriptive movements using one embodiment of the art described herein.
   a) The operator will attach a resistance band to the 12 o'clock position, then operator will place a foot in the securing strap on the top platform and move through dorsiflexion, abduction, adduction, inversion, eversion, supination, and pronation planes of motion.
   b) The operator will attach resistance bands to the 11, 12, and 1 o'clock positions, then operator will place a foot in the securing strap on the top platform and move through dorsiflexion, abduction, adduction, inversion, eversion, supination, and pronation planes of motion.
   c) The operator will attach resistance bands to the 10, 11, 12, 1, and 2 o'clock positions, then operator will place a foot in the securing strap on the top platform and move through dorsiflexion, abduction, adduction, inversion, eversion, supination, and pronation planes of motion.
   d) The operator will attach a resistance band to the 6 o'clock position, then operator will place a foot in the securing strap on the top platform and move through plantarflexion, abduction, adduction, inversion, eversion, supination, and pronation planes of motion.
   e) The operator will attach resistance bands at the 5, 6, and 7 o'clock positions, then operator will place a foot in the securing strap on the top platform and move through plantarflexion, abduction, adduction, inversion, eversion, supination, and pronation planes of motion.
   f) The operator will attach resistance bands to the 4, 5, 6, 7, and 8 o'clock positions, then operator will place a foot in the securing strap on the top platform and move through plantarflexion, abduction, adduction, inversion, eversion, supination, and pronation planes of motion.
   g) The operator will attach a resistance band to the 3 o'clock position, then operator will place a foot in the securing strap on the top platform and move through dorsiflexion, plantarflexion, abduction, adduction, inversion, eversion, supination, and pronation planes of motion.
   h) The operator will attach resistance bands to the 2, 3, and 4 o'clock positions, then operator will place a foot in the securing strap on the top platform and move through dorsiflexion, plantarflexion, abduction, adduction, inversion, eversion, supination, and pronation planes of motion.
   i) The operator will attach a resistance band to the 9 o'clock position, then operator will place a foot in the securing strap on the top platform and move through dorsiflexion, plantarflexion, abduction, adduction, inversion, eversion, supination, and pronation planes of motion.
   j) The operator will attach resistance bands to the 8, 9 and 10 o'clock positions, then operator will place a foot in the securing strap on the top platform and move through dorsiflexion, plantarflexion, abduction, adduction, inversion, eversion, supination, and pronation planes of motion.
3) Ankle stability: In one embodiment, the operator will place a foot in the center of top platform, without resistance bands, and balance while opposite foot hangs free, and/or the free hanging foot's leg move through flexion, extension, abduction, and adduction planes of motion.

Although various systems herein, such as system 10, 100, 200, 300, 400, 500 for example, are referred to herein as "systems", those with skill in the art will understand that such systems can also be referred to herein as "devices" or "apparatuses".

While the foregoing descriptions and drawings should enable one of ordinary skill to make and use what is presently considered to be the best mode of the invention, they should be regarded in an illustrative rather than a restrictive manner in all respects. Those of ordinary skill will understand and appreciate the existence of countless modifications, changes, variations, combinations, rearrangements, substitutions, alternatives, design choices, and equivalents ("Alternatives"), which can be made without departing from the spirit and scope of the invention.

Therefore, the invention is not limited by the described embodiments and examples but, rather, encompasses all possible embodiments within the valid scope and spirit of the invention as claimed, as the claims may be amended, replaced or otherwise modified during the course of related prosecution. Any current, amended, or added claims should be interpreted to embrace all further modifications, changes, rearrangements, substitutions, alternatives, design choices, and embodiments that may be evident to those of skill in the art, whether now known or later discovered. All equivalents should be considered within the scope of the invention, to the extent expressly disclaimed during prosecution or to the extent necessary for preserving validity of particular claims in light of the prior art.

What is claimed is:

1. An apparatus for providing resistance-based extremity strengthening, comprising:

a base configured to be placed on or secured to a floor or other surface;

a platform configured to be engaged by a user;

a joint coupling the base and the platform and aligned with a center axis of the platform, the joint having a fulcrum point and configured to allow for the platform to rotate about the fulcrum point in all three planes, the joint including:

a socket coupled to a bottom surface of the platform, a ball element coupled to a top surface of the base and including a stem and a ball disposed at a top end of the stem configured to engage the socket, and a coupling threadedly coupled to a bottom end of the socket to engage the ball with the socket, wherein a bottom surface of the coupling is shape to limit an amount by which the platform is able to pitch and roll; and a plurality of elastic resistance bands each having a first end configured to be selectively engaged with any of a plurality of platform connection points of the platform, and a second end configured to be selectively engaged with any of a plurality of base connection points of the base, wherein the plurality of platform connection points are disposed about an outer section of the platform, each of the plurality of platform connection points disposed at a first distance from the center axis of the platform, and wherein each of the plurality of base connection points are disposed on the base on a same vertical plane as a corresponding one of the plurality of platform connection points and at a second distance from the center axis of the platform, where the second distance is less than or equal to the first distance.

2. The apparatus of claim 1, wherein the joint is a ball-and-socket joint.

3. The apparatus of claim 2, wherein the joint further comprises:

a sleeve coupled to the top surface of the base, wherein the stem is configured to be inserted into the sleeve.

4. The apparatus of claim 3, wherein:

the stem includes a plurality of through-holes disposed along a length of the stem;

the sleeve includes a pin hole with which one of the plurality of through-holes is configured to be axially aligned; and the joint further includes a pin configured to pass through the pin hole of the sleeve and engage an aligned through-hole of the plurality of through-holes of the stem, wherein a height of the joint is adjustable based on which of the plurality of through-holes is engaged by the pin.

5. The apparatus of claim 1, wherein:

the joint is configured to have an adjustable height; and a distance between the platform and the base is configured to be changed based on a height of the joint.

6. The apparatus of claim 1, wherein:

each of the plurality of platform connection points comprises a slot spanning a thickness of the platform and formed in an outer circumferential edge of the platform such that the first end of any of the plurality of elastic resistance bands is configured to radially enter the slot from the outer circumferential edge of the platform relative to the center axis of the platform;

the first end of each of the plurality of elastic resistance bands includes a stopper, wherein the stopper has a cross-section that is wider than a cross-section of an elastic portion of the elastic resistance band; and the first end of each of the plurality of elastic resistance bands is configured to be coupled to any of the plurality of platform connection points by radially inserting the elastic portion into the slot and seating the stopper in the slot.

7. The apparatus of claim 1, wherein:

each of the plurality of base connection points comprises a through-hole positioned on the top surface of the base; and the second end of each of the plurality of elastic resistance bands includes a hook and is configured to be coupled with any of the plurality of base connection points by inserting the hook into the through-hole.

8. The apparatus of claim 1, further comprising:

a strap configured to couple the user's foot to the platform.

9. The apparatus of claim 1, further comprising a hand grip disposed on a top surface of the platform.

10. An apparatus for providing resistance-based extremity strengthening, comprising:

a base configured to be placed on or secured to a floor or other surface;

a platform configured to be engaged by a user;

a joint coupling the base and the platform, the joint coupled to a top surface of the base and a bottom of the platform and including:

a socket coupled to the bottom surface of the platform, a ball element coupled to a top surface of the base and including a stem and a ball disposed at a top end of the stem configured to engage the socket, and a coupling threadedly coupled to a bottom end of the socket to engage the ball with the socket; and a plurality of elastic resistance bands each having a first end configured to be coupled to the platform and a second end configured to be coupled to the base, wherein the platform is configured to be rotated about a rotation point of the joint such that the rotation is resisted by the plurality of elastic resistance bands.

11. The apparatus of claim 10, wherein:

the joint is configured to have an adjustable height; and a distance between the platform and the base is configured to be changed based on the adjustable height of the joint.

12. The apparatus of claim 11, wherein the joint is a ball-and-socket joint and further comprises:

a sleeve coupled to the top surface of the base and including a pin hole, wherein the stem is configured to be inserted in the sleeve and the ball is configured to engage the socket, wherein the stem includes a plurality of through-holes disposed along a length of the stem; and a pin configured to pass through the pin hole of the sleeve and engage one of the plurality of through-holes of the stem axially aligned with the pin hole, wherein the adjustable height of the joint is adjustable based on which of the plurality of through-holes is engaged by the pin.

13. The apparatus of claim 12, wherein the coupling is configured to limit an amount by which the platform is able to pitch and roll.

14. The apparatus of claim 10, wherein:

the first end of each of the plurality of elastic resistance bands is configured to be selectively coupled with any of a plurality of platform connection points; and the second end of each of the plurality of elastic resistance bands is configured to be selectively coupled with any of a plurality of base connection points.

15. The apparatus of claim 14, wherein:

the plurality of platform connection points are disposed about an outer section of the platform, each of the plurality of platform connection points disposed at a first distance from a center axis of the platform; and each of the plurality of base connection points are disposed on the base on a same vertical plane as a corresponding one of the plurality of platform connection points and at a second distance from the center axis of the platform, where the second distance is less than or equal to the first distance.

16. The apparatus of claim 14, wherein:

each of the plurality of platform connection points comprises a slot spanning a thickness of the platform and formed in an outer circumferential edge of the platform such that the first end of any of the plurality of elastic resistance bands is configured to radially enter the slot from the outer circumferential edge of the platform relative to a center axis of the platform;

the first end of each of the plurality of elastic resistance bands includes a stopper, wherein the stopper has a cross-section that is wider than a cross-section of an elastic portion of the elastic resistance band; and the first end of each of the plurality of elastic resistance bands is configured to be coupled to any of the plurality of platform connection points by radially inserting the elastic portion into the slot and seating the stopper in the slot.

17. The apparatus of claim 14, wherein:

each of the plurality of base connection points comprises a through-hole positioned on the top surface of the base; and the second end of each of the plurality of elastic resistance bands includes a hook and is configured to be coupled with any of the plurality of base connection points by inserting the hook into the through-hole.

18. The apparatus of claim 10, wherein the joint is aligned with a center axis of the platform and is configured to allow for the platform to rotate about the rotation point of the joint in all three planes.

19. A method for providing resistance-based extremity strengthening, comprising:

providing a resistance extremity strengthening apparatus, including:

a base configured to be placed on or secured to a floor or other surface, a platform configured to be engaged by a user, a joint coupling the base and the platform and aligned with a center axis of the platform, the joint having a fulcrum point and configured to allow for the platform to rotate about the fulcrum point in all three planes, the joint including:

a socket coupled to a bottom surface of the platform, a ball element coupled to a top surface of the base and including a stem and a ball disposed at a top end of the stem configured to engage the socket, and a coupling threadedly coupled to a bottom end of the socket to engage the ball with the socket, and a plurality of elastic resistance bands configured to couple the base and the platform;

coupling a first end of each of the plurality of elastic resistance bands with any one of a plurality of platform connection points of the platform, wherein the plurality of platform connection points are disposed about an outer edge of the platform, each of the plurality of platform connection points disposed at a first distance from the center axis of the platform;

coupling a second end of each of the plurality of elastic resistance bands with any one of a plurality of base connection points of the base, wherein each of the plurality of base connection points are disposed on the base on a same vertical plane as a corresponding one of the plurality of platform connection points and at a second distance from the center axis of the platform, where the second distance is less than or equal to the first distance; and rotating, by the user, the platform about the fulcrum point of the joint, wherein the rotation is resisted by the plurality of elastic resistance bands.

20. The method of claim 19, wherein:

the joint is configured to have an adjustable height; and the method further comprises adjusting the adjustable height of the joint, and thereby adjusting a distance between the base and the platform, to provide for a desired distance between the base and the platform.

* * * * *